US011408608B2

(12) United States Patent
Masterson

(10) Patent No.: US 11,408,608 B2
(45) Date of Patent: Aug. 9, 2022

(54) SOLID FUEL BURNING SYSTEM WITH ELECTRONIC IGNITION

(71) Applicant: Masterson Enterprises, Inc., Mt. Prospect, IL (US)

(72) Inventor: Daniel J. Masterson, Geneva, IL (US)

(73) Assignee: Masterson Enterprises, Inc., Mt. Prospect (IL)

( * ) Notice: Subject to any disclaimer, the term of this patent is extended or adjusted under 35 U.S.C. 154(b) by 103 days.

(21) Appl. No.: 16/658,708

(22) Filed: Oct. 21, 2019

(65) Prior Publication Data

US 2020/0049344 A1 Feb. 13, 2020

Related U.S. Application Data

(62) Division of application No. 14/912,872, filed as application No. PCT/US2014/051673 on Aug. 19, 2014, now Pat. No. 10,451,272.

(60) Provisional application No. 61/967,524, filed on Mar. 21, 2014, provisional application No. 61/959,181, filed on Aug. 19, 2013.

(51) Int. Cl.

| | |
|---|---|
| ***F23D 5/04*** | (2006.01) |
| ***F23D 3/16*** | (2006.01) |
| ***F23D 3/24*** | (2006.01) |
| ***F23D 3/32*** | (2006.01) |
| ***F23D 3/08*** | (2006.01) |

(52) U.S. Cl.

CPC ..... *F23D 5/04* (2013.01); *F23D 3/08* (2013.01); *F23D 3/16* (2013.01); *F23D 3/24* (2013.01); *F23D 3/32* (2013.01); *F23D 2900/03082* (2013.01)

(58) Field of Classification Search

CPC ..... F23D 3/24; F23D 3/32; F23D 3/08; F23D 3/18; F23D 3/16; F23D 5/04; F23D 2900/03082

See application file for complete search history.

(56) References Cited

U.S. PATENT DOCUMENTS

| | | | | |
|---|---|---|---|---|
| 601,128 | A | 3/1898 | Dally | |
| 1,327,048 | A | 1/1920 | Kinealy | |
| 1,957,014 | A | 5/1934 | Humpoletz | |
| 2,622,017 | A | 2/1949 | Bramhall et al. | |
| 3,428,409 | A | 9/1966 | Summers | |
| 4,437,832 | A | 3/1984 | Amano et al. | |
| 5,840,246 | A | 11/1998 | Hammons et al. | |
| 6,371,756 | B1 | 4/2002 | Toohey | |
| 6,733,279 | B2 * | 5/2004 | Thigpen | F21S 13/12 431/253 |
| 6,857,869 | B1 | 2/2005 | Sun | |
| 2003/0086815 | A1 | 5/2003 | Wesley | |
| 2006/0057521 | A1 | 3/2006 | Kubicek et al. | |

(Continued)

FOREIGN PATENT DOCUMENTS

| | | | |
|---|---|---|---|
| AT | 509247 | A2 | 7/2011 |
| GB | 915524 | A | 3/1959 |

(Continued)

*Primary Examiner* — Alfred Basichas

(74) *Attorney, Agent, or Firm* — Erickson Law Group, PC

(57) ABSTRACT

A solid fuel burning system and method with an electronic ignition circuit is provided having a filament. The filament is attached to the filament support. The filament is adjacent the wick. The electronic ignition circuit is configured to direct power to the filament to cause the filament to generate heat.

19 Claims, 37 Drawing Sheets

(56) References Cited

U.S. PATENT DOCUMENTS

| | | | |
|---|---|---|---|
| 2007/0264603 | A1 | 11/2007 | Ruff |
| 2013/0101946 | A1 | 4/2013 | Masterson |
| 2013/0115565 | A1 | 5/2013 | Masterson et al. |

FOREIGN PATENT DOCUMENTS

| | | | |
|---|---|---|---|
| WO | 2009/152502 | A1 | 12/2009 |
| WO | 2009152504 | A1 | 12/2009 |

* cited by examiner

SOLID FUEL BURNING SYSTEM WITH ELECTRONIC IGNITION

This application is a divisional application of U.S. patent application Ser. No. 14/912,872, which is a section 371 national stage of PCT/US2014/051673, filed on of Aug. 19, 2014, which claimed the benefit of U.S. Patent Application No. 61/959,181, filed on Aug. 19, 2013, and U.S. Patent Application No. 61/967,524, filed on Mar. 21, 2014, each application naming Daniel J. Masterson as an inventor, and each of the forgoing identified applications are incorporated herein by reference in their entirety.

FIELD OF THE INVENTION

The invention relates to fuel burners and more specifically systems for burning solid fuels, such as wax.

BACKGROUND OF THE INVENTION

Typically wax is used as a fuel in traditional candles. Traditional candles transfer heat to melt the wax around a wick via radiation. The process delivers heat slowly and inefficiently resulting in a slow rate of melting the wax around the wick and creating the melt pool. Performance candles, candles that are used to drive a volatile active ingredient into the air, rely on developing a melt pool since the rate of active delivery is dependent on the size or surface area of the pool. Traditional candles can take four or more hours to create a melt pool of sufficient size to fill a typical room or area with its volatile active ingredient.

At the same time, because the flame size is limited and the resulting heat flux generated by the flame so small, the operating temperature of a candle melt pool is barely above the melt temperature of the wax, which limits the rate and the completeness of the volatile chemical delivery and limits the pallet of active ingredients that can be functional to those that work at lower temperatures.

Because of the small flame, slow melt pool development, and low operating temperature of the melt pool, performance candles suffer from sluggish and incomplete delivery. Performance candle formulators (like perfumers) are restricted to a limited breadth of ingredients that can be effectively used.

Further, traditional candles have flame sizes that are greatly limited. Candles used indoors are limited in size and in heat of the flame due to the creation of soot as the candle/wick system increases in size. As such products move outdoors, where soot can be accommodated, larger flames become increasingly difficult to create because larger wicks become difficult to ignite. This is due to the overall mass and heat capacity of the wick and wax, which makes it difficult or impossible to vaporize the fuel for ignition.

Indoor or traditional candle type products are therefore limited in flame size and heat delivery. The indoor use of candles can be used for lighting as well as delivery of a volatile active ingredient like fragrance, medicinal ingredients, or insect repellent (if used outdoors). Unfortunately, the flame size and heat limitations of the traditional wick and wax systems result in products that create low light and take exceptionally long times for the melt pool to develop. Since the active delivery is a function of both the wax/fuel melt pool size and operating temperature, the volatile active ingredient is slow to release and to be delivered to the surroundings. Even the Glade™ Scented Oil Candle that uses metal fins within the flame takes almost an hour to create a melt pool. In the outdoor use environment, this melt pool issue is exacerbated because of cooler air temperatures or the cooling effects of breezes.

Outdoor products rely on more flammable fuels like mineral oils or alcohols. Alcohol fuels like ethanol, isopropyl alcohol, and other short chain alcohols have recently been recalled due to their extreme flammability and ability to carry the fire without a wick. Mineral oil type fuels, like those used in yard torches, are acutely toxic to the respiratory system upon even the slightest ingestion. In addition, the liquid fuels are prone to creating excessive soot and develop and deliver an oil refinery off odor.

The present inventor has recognized that waxes, including but not limited to paraffin, soy wax, palm wax, beeswax, and others, would make ideal fuels, especially for outdoor products that desire and require larger flames. Additionally, the present inventor has recognized that indoor applications could benefit from both light intensity improvements as well as faster wax pool development. The present inventor recognizes the need for a device that allows for faster wax pool melting and increased heat production.

Further, wicks or wick material often function as a filter and, like filters, are prone to fouling or clogging resulting from prolonged use or use with "dirty" filtrate (or fuel in the case of wicks). Most wicks are consumable and are not plagued by fouling or clogging; yet the phenomenon presents itself and can be dangerous as carbon pills form at the end of consumable wicks.

The present inventor has recognized that the benefits of a reusable or permanent wick are many and varied and include, but are not limited to, flame control, flame staging, and, in some applications, creating flames of unique geometry, hotter flames, larger stable flames, and less soot. However, reusable wicks are prone to clogging or fouling by the fuel used—especially fuels that contain higher levels of longer chain hydrocarbons (products like waxes or paraffin). These kinds of fuel with repeated use can lead to build-up of varnish, tar, carbon deposits, and other materials that can prevent the liquid fuel from flowing through the wick material, which results in diminished performance (smaller flames) and ultimately complete failure. In effect, the chemical nature of hydrocarbon fuels and their natural inclusion of longer chain components (even at very low levels) has heretofore made using permanent or reusable wicks difficult or practically impossible.

The present inventor has recognized the need for a device that allows reusable or permanent wicks while diminishing or eliminating the cumulative effects of fouling or clogging caused by hydrocarbon fuels.

Moreover, the present inventor has recognized that unlike traditional candles with a consumable wick, reusable and permanent wick candles offer the user the option to make larger and more stable flames, to create wax burners that shed more light, to create candles that produce larger and warmer melt pools that in turn more effectively deliver a volatile ingredient to the environment, and to repeatedly operate the system with no waste.

However, since the reusable or permanent wick remains with the burner apparatus, consideration is needed for preparing the wick for reuse. The present inventor has recognized that when the wick is barren of any fuel, it may require priming. The present inventor has recognized that priming must be enough to allow easy ignition without taking too long to ignite or without flooding the point of ignition. Then that first ignition point must provide enough heat to the surrounding wax to stoke the developing flame without melting so much wax that the melted wax restricts or even douses the developing flame. The present inventor has recognized that an imbalance of both the priming and stoking stages of the developing flame can result in starving the flame or in partially or completely flooding the first ignition.

The present inventor has recognized the need for a solid fuel, such as solid wax structure that repeatedly and reliably offers a natural priming location for wick ignition and then automatically manages the stoking stage to allow uninhibited and full development of the desired flame. Further, the present inventor recognized the need for a device that provides a main wax portion that is to be melted by the flame and used through complete melt and combustion.

The present inventor recognized that some permanent wicks can be hard to ignite, especially as the cumulative ignitions or uses increases above 20 to 40 ignitions. Often times, the time to ignite can reach in excess of 40 seconds. This makes a reusable wick difficult to ignite with a lighter and very difficult or impossible to ignite with matches. One way to make it easier to ignite is to expose more wick. However, this makes the resulting flame too tall and often prone to generating soot. Therefore there is a trade-off between ease of ignition and size, safety, and suitability of the flame. While larger flames may be accommodated for outdoor products like a torch or fire pot, the large flame and propensity to soot is unacceptable for indoor applications.

The present inventor recognized the need for a system that reduces both the time to ignition as well as the operating flame height of the resulting flame. Further, the present inventor recognized the need for the reduction in ignition time and flame height to be maintained and/or not to be deteriorated or significantly altered through successive uses, such as in some case above 20 or above 50 ignitions.

Certain candles are composed of a wax mass within which a cotton or other consumable material wick passes through the wax mass and exposing the uppermost portion of the wick for ignition. The wick used in such candles is typically pre-primed with wax to enable the first ignition. The art of candle making has, over thousands of years, been focused on perfecting the delicate balance of the wax fuel and the consumable wick. Once lit the wick delivers the melted wax to the flame and, as the fuel is used, the wick burns off (often causing wisps of soot) and the flame travels down to meet the fuel. A candle, however, requires an external ignition source, which is typically a match or a lighter. Because of this, a candle is prone to several inconveniences and dangers including but not limited to (1) burn hazards, especially if the wick takes too long to ignite; (2) inconvenience of not having an ignition source available to use as it may be misplaced, out of fuel, or difficult for itself to ignite; and, (3) in some cases, as in jar candles, the wick is difficult to reach and becomes dangerous to light or requires a specific or special kind of lighter (like a wand lighter), these jar style candles and other "sunk" candle designs are specially prone to burn or hot wax spilling hazards.

The present inventor recognized that it would be desirable to have a device to ignite a candle or similar wax burning assembly that is safer and more convenient. In particular, a device where the ignition mechanism or system is neither obtrusive to the flame nor obvious or visible.

The present inventor recognized that the use of a fixed position system, like a hot filament, on traditional candles will not work repeatedly since the point of ignition (the consumable wick) moves as the candle is used and the fuel is depleted. This makes the candle unable to be re-lit repeatedly and throughout the life of the candle with a fixed position system. Furthermore, the addition of any ignition system upon a traditional candle wick will obstruct the flame, be obvious or too visible, or both. Therefore, the present inventor recognized it would be desirable for a solid fuel burning system to have a reliable, convenient, and repeatable device for ignition.

Kerosene and propane heaters use a filament or piezo electric techniques to promote ignition without needing a match, lighter, or eternal flame. However, kerosene, propane, butane and other fuels that use such techniques are flammable, with fire ratings of 3 and 4, and volatile liquids or gases and require little energy to reach an ignition point. Furthermore, these fuel types are incapable of flooding or extinguishing their own flame. The use of a filament or piezo electric techniques have not been applied to candles or other wax burning assemblies previously for at least the following reasons recognized by the inventor: (1) solid wax is a non-flammable fuel, with a fire rating of 1, and, as such, imposes several thermodynamic challenges, such as: (a) the solid wax fuel must go through two phase transitions, from solid to liquid, and then from liquid to vapor, in order to ignite, (b) the solid wax fuel needs to reach a much elevated ignition temperature for ignition; (2) due to the solid wax fuel's non-flammable nature, an assembly using solid wax is prone to dowsing its own flame out with its own fuel (flooding); and (3) high temperature exposure of a filament to oxygen causes reduced life and increased frailty of the filament, making extended use difficult. The present inventor recognized a need to overcome these drawbacks and provide other benefits in a wax burning system with electric ignition.

SUMMARY OF THE INVENTION

A wax burning system having an electronic ignition circuit is disclosed. In some embodiments, the system has a melted wax reservoir, a melting grate, a wick, a filament support, and the electronic ignition circuit. The melting grate is configured to receive a solid wax. The melting grate is located above at least a portion of the melted wax reservoir so that wax melted on the melting grate can be received into the melted wax reservoir. The wick has a hollow core and an upper exit opening in communication with the hollow core. The electronic ignition circuit has a filament. The filament is attached to the filament support. The filament is adjacent the wick. The filament is at least partially below a top of the wick. The electronic ignition circuit is configured to direct power to the filament to cause the filament to generate heat.

In some embodiments, the wax burning system comprises a melting plate, a wick, a filament support, and an electronic ignition circuit. The wick has a hollow core and an upper exit opening in communication with the hollow core. The wick is supported on the melting plate. The electronic ignition circuit has a filament. The filament is attached to the filament support. The filament is adjacent the wick. The filament is at least partially below a top of the wick. The electronic ignition circuit is configured to direct power to the filament to cause the filament to generate heat.

In some embodiments, the wax burning system comprises a wick, a filament support, an electronic ignition circuit, and a solid wax. The wick has a hollow core and an upper exit opening in communication with the hollow core. The electronic ignition circuit has a filament. The filament is attached to the filament support. The filament is adjacent the wick. The filament is at least partially below a top of the wick. The electronic ignition circuit is configured to direct power to the filament to cause the filament to generate heat. The solid wax is configured to extend over the wick and the filament.

A method of operating a wax burning system with an electronic ignition system is disclosed. A solid fuel is located on a melting grate adjacent to a wick. The solid fuel has a priming section. The wick has a hollow core. The priming section is positioned adjacent the wick. At least a portion of the priming section is heated with a filament adjacent the wick so that a portion of the priming section melts and falls onto the wick. The filament is within the hollow core of the wick. The wick is ignited with heat from the filament when the wick comprises a sufficient amount of fuel to support a flame and when the fuel reaches an ignition temperature.

Numerous other advantages and features of the present invention will become readily apparent from the following detailed description of the invention and the embodiments thereof, from the claims and from the accompanying drawings.

DETAILED DESCRIPTION

Figure 1:
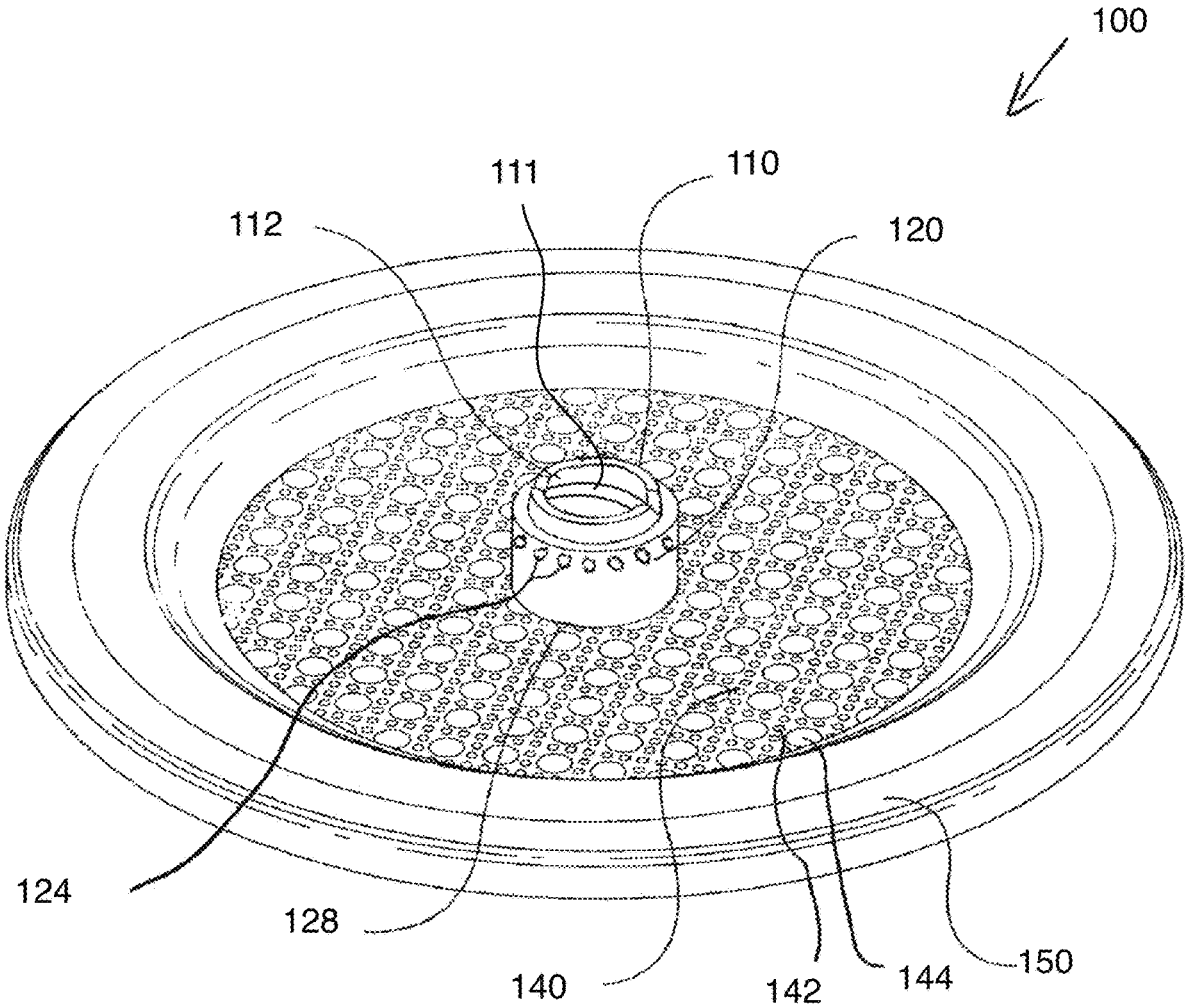
FIG. 1 is a perspective view of one embodiment of a fuel burning system of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
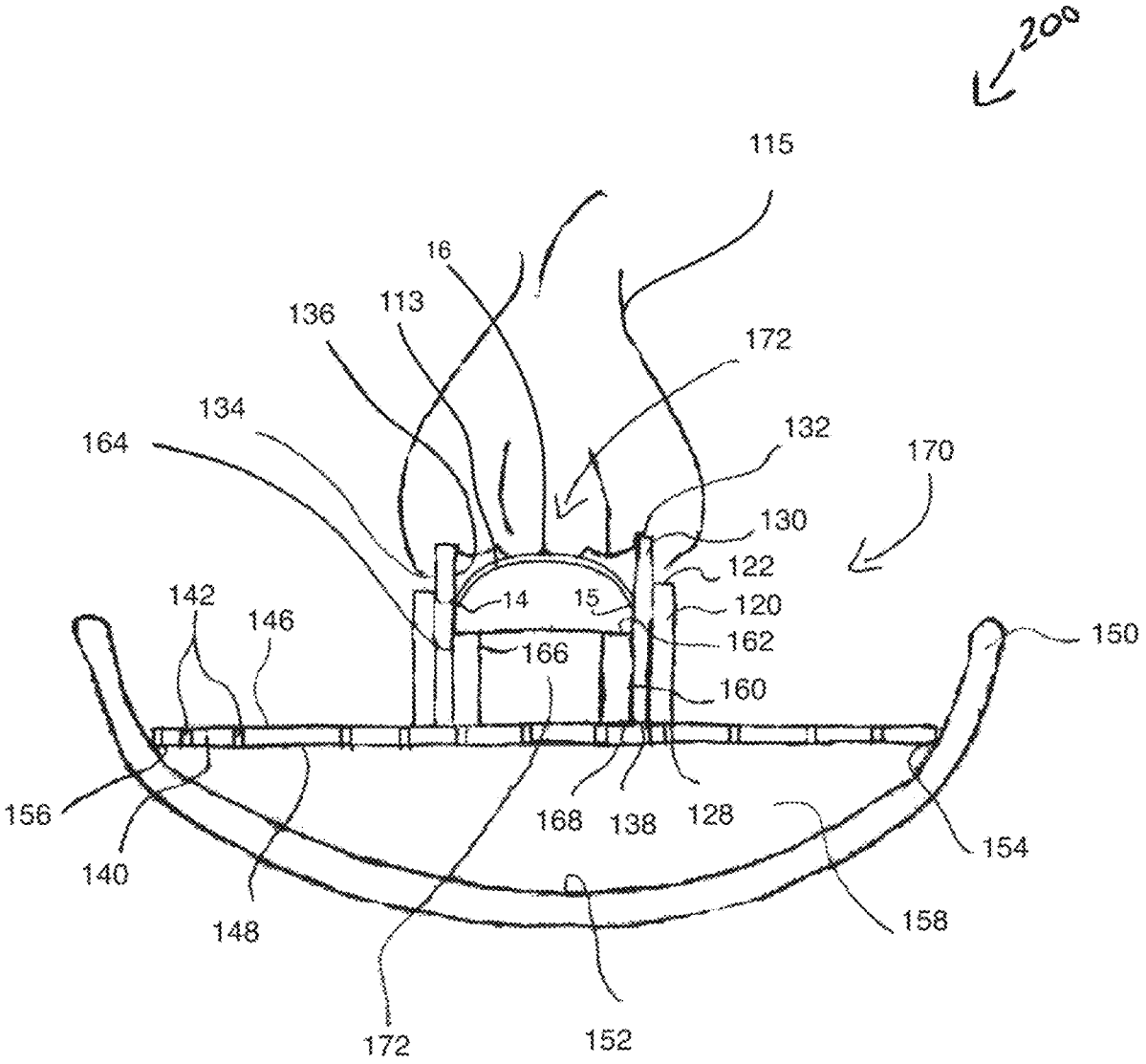
FIG. 2 is a sectional side view of a second embodiment of a fuel burning system of the invention.

System Overview. FIG. 1 shows an embodiment of a solid fuel burner system 100. The burner system 100 comprises a hollow-core wick 110, a burn chamber 112, a wick sheath 120, a melting grate 140, and a fuel reservoir 150, such as a bowl or basin. The wick comprises at least one bridge 111. FIG. 2 show a second embodiment 200 of the burner system 100 of FIG. 1 with an alternative embodiment hollow-core wick 130 and an inner wick support ring 160. The wick 130 has a bridge 113. The hollow-core wick 130 of FIG. 2 is substituted for the hollow-core wick 110 of FIG. 1.

In general operation, a solid fuel, such as solid fuel 280, is placed on the melting grate. The wick is lit and the resulting flame 115 begins to heat the solid fuel causing it to melt. The melted fuel flows through the melting grate and into the fuel reservoir. The melted fuel is drawn into the wick to continue fueling the flame at the wick. The flame transmits heat to the solid fuel in at least two ways. First, heat from the flame is transmitted through the ambient air to the solid fuel. Second, heat is thermally transferred through the wick sheath and the melting grate to the fuel which is in contact with the melting grate. In some arrangements, wax may fall directly on the wick to prime the wick during initial operation until fuel is drawn into a bottom portion of the wick for feeding the flame at the top of the wick.

The reservoir 150 comprises a curved shape having a bottom 152 with upwardly curving sides 154, 156. The width of the melting grate 140 is sized to contact the sides 154, 156 of the bowl to position the bottom 148 of the melting grate 140 a pre-defined distance from the bottom of the reservoir. The volume of space between the bottom 152 of the reservoir 150 and the bottom 148 of the melting grate 140 is the lower fuel reservoir area 158.

The melting grate is suspended above at least the lower most portion of the bottom 152 of the reservoir 150. The bowl or basin may comprise other shapes other than curved, for example the bottom may be flat with obliquely angled side walls for intersecting with the melting grate.

The top 146 of the melting grate establishes a support surface for the wick system 170 and for solid fuel 201. Melting grate comprises a plurality of holes 142, 144 that allow melted fuel, such as melted wax to travel from the top surface of the melting grate down into the reservoir. The holes may be different sizes as that there are larger holes 144 and smaller holes 142. The wick system 170 comprises a wick, such as wick 110 or 130, the wick sheath 120, and optionally the wick support ring 160. The wick system 170 creates a burn chamber 172 within the hollow-core wick 130 and bounded by the wick sheath.

The hollow-core wick 130 has an upper surface 132 and a lower surface 138. The upper surface 132 of the wick may comprise a plurality of peaks 135 and valleys 131. The wick sheath has an upper surface 122, and a lower surface 128. The wick support ring 160 has an upper surface 162 and a lower surface 168. The lower surfaces 168, 138, 128 of each of the wick support ring 160, the wick 130, and the wick sheath 120 are supported on the upper surface of the melting grate 140. The wick system 170 may be placed on the melting grate in any particular location. In some embodiments, the wick system is centered on the melting grate. In some embodiments, the melting grate is 4.25 inches in diameter, but many other sizes are also possible. Each of the wick sheath 120, the wick 130, and the wick support ring 160 comprises a cylindrical shape, however, in some embodiments, each may comprise other shapes such as such a shown and described in FIGS. 22C-22G and 37-41.

In some embodiments, the inside surface 136 of the wick sheath 120 is in contact with the outside surface of the wick 130 and the inside surface 136 of the wick 130 is in contact with the outside surface of the wick support ring 160. In some embodiments, the inside surface 126 of the wick sheath 120 is in close proximity but not in surface-to-surface contact with the outside surface of the wick 130 and the inside surface 136 of the wick is in close proximity with the outside surface of the wick support ring 160. The close proximity may comprise distances in the range of about 0.001 of an millimeters to about 5 millimeters. In the embodiment shown in FIG. 2, the wick support ring is shorter than the wick sheath, which is shorter than the wick.

In some embodiments, a melting plate replaces the melting grate. The melting plate does not have any holes and the wick 130 is fed through lower holes (not shown) in the wick sheath.

In some embodiments, the reservoir is arranged to be positioned relatively close to the wick system to promote fast melt pool creation. The shape of the reservoir allows for a falling of melted wax toward the flame. The wax systematically melts from heat conduction, typically from the melting grate or a plate supporting the wick system. This is done by creating a shape that shifts the center of gravity of the melted wax toward the wick system as the wax melts.

The wick sheath comprises a plurality of air intake apertures or holes 124. The holes 124 are spaced apart about the circumference of the wick sheath. The holes are located adjacent to the upper surface 122 of the wick sheath 120. In some embodiments, the holes are located in the top half or top quarter of the height of the wick sheath. In some embodiments, the holes are 0.06 inches in diameter and allow air into the burn chamber. The holes 124 allow air to be pulled through the porous wick and into the burn chamber. The air intake holes allow an increased amount of oxygen to be introduced into the burn system thereby resulting in a higher burning/operating temperature.

The number and size of air intake holes 124 in the wick sheath affects the burn performance of the wick system 170. For example, the flame can be reduced by utilizing fewer holes or no holes, thereby reducing or starving the combustion of oxygen. On the other end of the spectrum, if the number and/or size of the holes are too great, too much oxygen will be allowed and the flame will be too large for its intended use. The number of holes will affect the stoichiometry of the combustion, generally by using oxygen as the limiting reactant to make larger, soot free, stable flames. Finally, if the holes are too large and expose too much of the porous wick material, the exposed side of the wick at the hole could ignite. In some embodiments, it is preferred that the holes be less than ⅛ of an inch in diameter. In some embodiments, it is further preferred that the holes be less 1/16 inch in diameter. In one embodiment, the wick sheath comprises at between 2 and 10 apertures spaced apart equally about the circumferential outer side wall of the wick sheath.

In some embodiments, the wick sheath may comprise non-porous material such as metal, such as aluminum, copper, steel, iron, nickel, or a combination thereof. In some embodiments, the wick sheath may a comprise material that has a lesser heat conductivity than metal but will survive a flame, such as ceramic, stone, refractory materials, glass, or a combination thereof. The inner wick support ring may comprise the same types of material just described for the wick sheath. The wick support ring is optional and is provided to maintain the shape of upstanding the wick adjacent or against the wick sheath. Some wick materials do not require a wick support ring for maintaining the wick's shape. The reservoir 150 may comprise wood, glass, ceramic, metal, and high melting resin. In some embodiments, the wick is comprised of ceramic fiber paper, such as Fiberfrax® Ceramic Paper 970A manufactured by Unifrax LLC of Niagara Falls, N.Y. In some embodiments, the wick is comprised of one or more of ceramic fiber paper, sintered glass, porous metals, porous ceramics, capillary glass, capillary metal, porous rock, metal weave, fiberglass, fiber glass cloth, refractory foam, refractory roll board, refractory tissue, refractory foam, refractory paper, refractory felt, refractory blanket, refractory tissue, carbon fiber woven cloth, and carbon composite.

Figure 3:
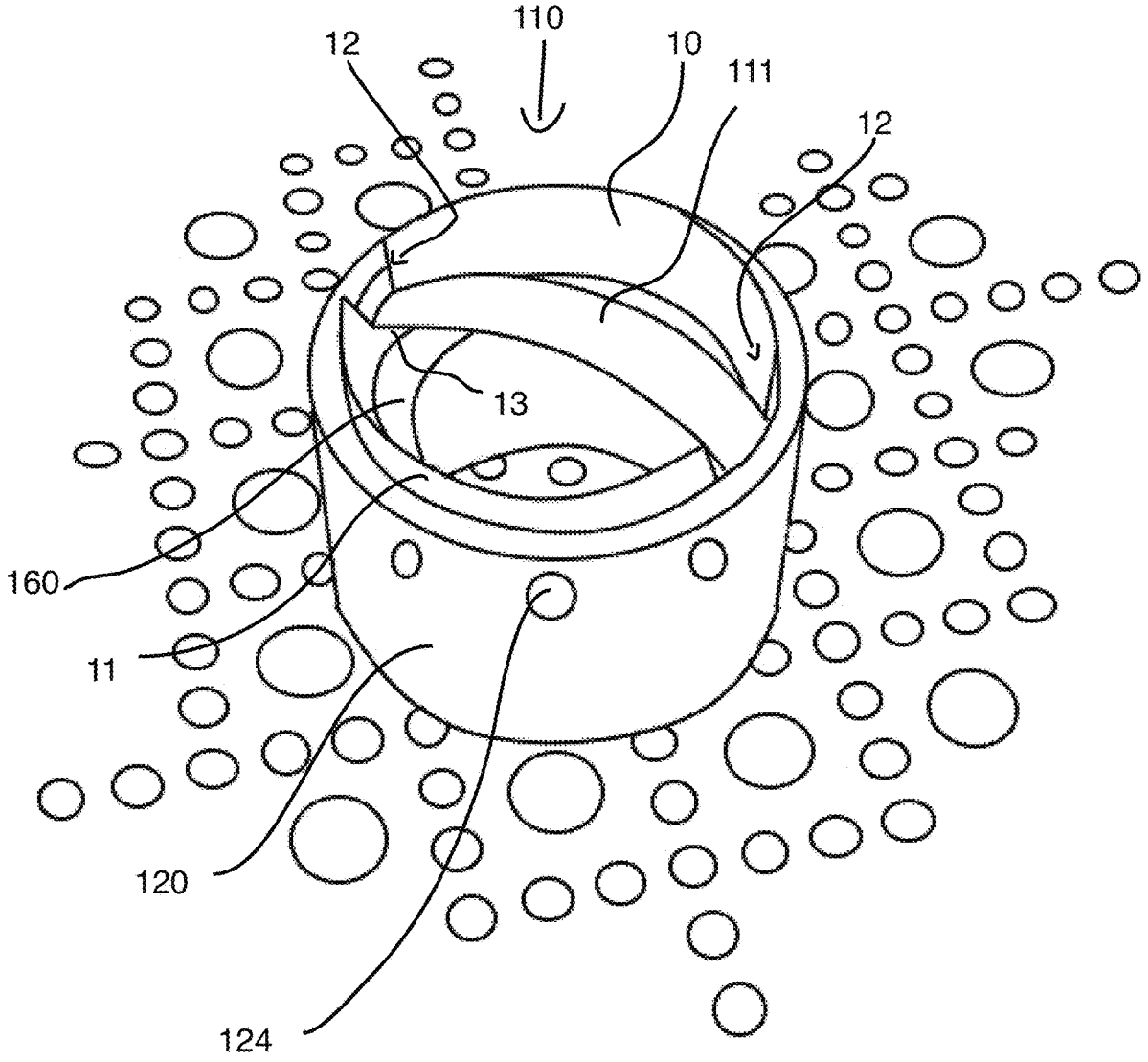
FIG. 3 is a perspective view of the fuel burning system of FIG. 1 with certain components not shown.

Bridge Wick. A shown in FIG. 3, the bridge 111 spans across the wick 110. In some embodiments, the bridge gaps 12 are formed in the wick adjacent the top of the wick at or adjacent the connection between the bridge 111 and the perimeter wall of the wick. When there are gaps 12, the gaps do not extend all the way down to the bottom of the wick, but instead the wick is continuous in an area 13 below the gaps and below the location of the bridge connection to the perimeter wall of the wick. The gaps 12 create separated upper wick portion 10, 11. In some embodiments, there are no gaps 12 such as in wick 130 of FIG. 2.

The bridge crosses from one side of the internal perimeter wall of the wick to an opposite side of the internal perimeter wall of the wick. In some embodiments, the bridge extends along a diameter of the wick passing through the geometric center of the hollow core wick before reaching the opposite side. In some embodiments, the bridge extends from one portion of the internal perimeter wall of the wick to another portion of the internal perimeter wall of the wick but does not pass through the geometric center of the wick.

The bridge 111, 113 bows or arches between the bridge attachment at opposite attachment points 14, 15 on opposite interior sides of the perimeter wall of the wick. The attachment points 14, 15, are located below the upper surface 132 of the wick. In some embodiments, the middle 16 of the bridge is located below the upper most edge of the upper surface 132 of the wick. In some embodiments, the middle 16 of the bridge is located level with the upper most edge of the upper surface 132 of the wick. In some embodiments, the middle 16 of the bridge is located above the upper most edge of the upper surface 132 of the wick. In some embodiments, the middle of the bridge is less than 0.5 inches above the upper most edge of upper surface 132 of the wick. In some embodiments, the middle of the bridge is less than 0.25 inches above the upper most edge of upper surface 132 of the wick. In some embodiments, the middle of the bridge is less than 0.25 inches above the top of the wick sheath 120. In some embodiments, the middle of the bridge is less than 0.1 inches above the top of the wick sheath 120. In some embodiments, the middle of the bridge between zero and 0.25 inches above the upper most edge of upper surface 132 of the wick.

When the bridge is ignited, the fuel and the flame will travel along the bridge and light the perimeter wall of the wick when the flame meets the perimeter wall of the wick at the attachment point 14, 15 of the bridge.

In some embodiments, the bridge has a width of 0.1 inch and a length of at least the diameter of the hollow core of the wick. To achieve an arch, the length of the bridge must be longer than the diameter of the hollow core of the wick, when the bridge extends along the diameter. When the bridge does not extend along the diameter of the wick, it may have a length that is less than the diameter of the wick.

In some embodiments, the wick protrudes above the top of the wick sheath 120 by no more than 0.15 inches to maintain a smaller operating flame height of 1.0 inch from the wick to the top of the flame.

Figure 4:
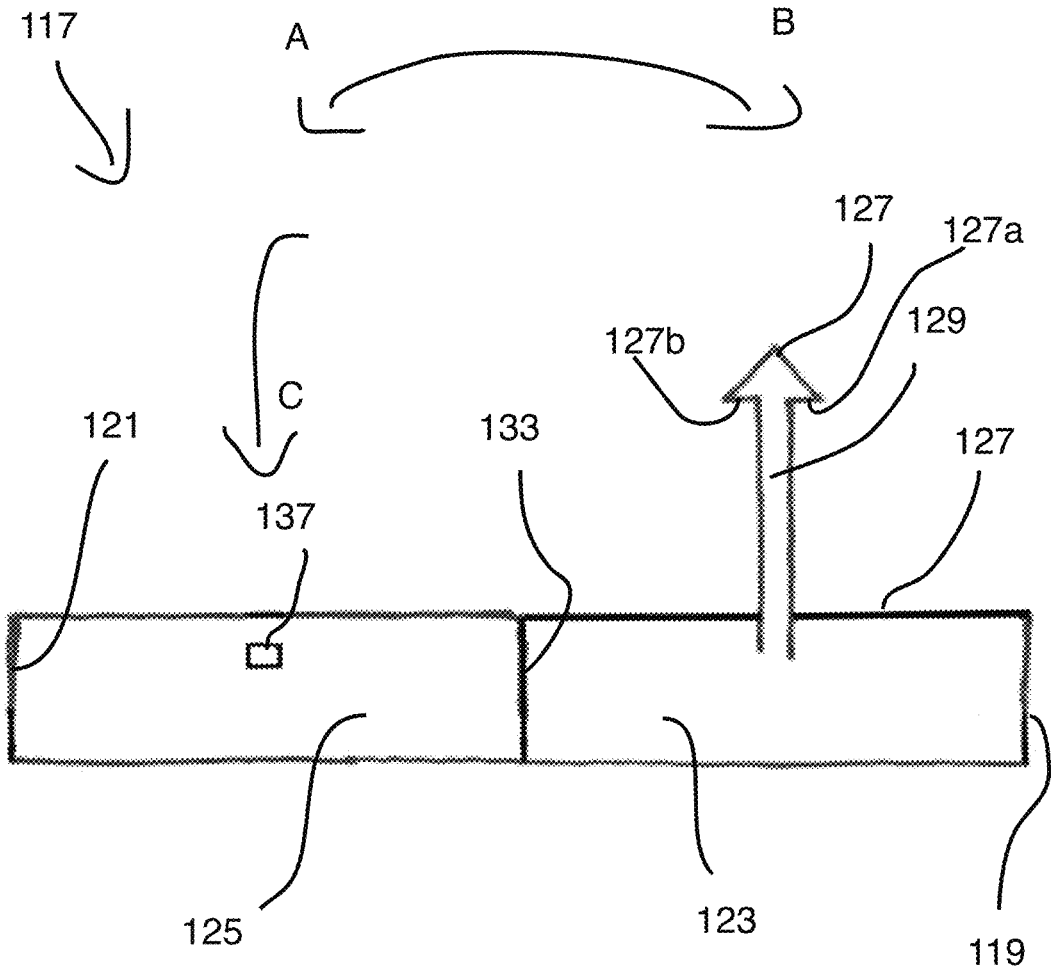
FIG. 4 is a side view of an embodiment of a wick from the system of FIG. 1 shown in a flattened position.

In some embodiments, the hollow core wick may begin as a flat wick, such as the wick 117 of FIG. 4. The wick 117 that is then curved so that the lateral edges 119, 121 are in contact or are adjacent to each other and a hollow core is formed in the center. A folding line or crease 133 may be provided delineating a first portion 123 and a second portion 125. The first portion 123 may be folded toward the second portion 125 in the direction A, the second portion 125 may be folded toward the first 132 in the direction B, or each portion 123, 125 may be folded toward the other so that lateral edges 119, 121 are joined or adjacent the other. The formed wick may be held in shape by the wick sheath 120 and the support ring 160.

The bridge 129 may be permanently attached to one of the portions 123, 125 and removably attached to the other. As shown in FIG. 4, one end of the bridge 129 has an arrow shape end 127, the bridge is arched in the direction C after or during the joining of the lateral edges 119, 121 and the arrow shape is pressed into a bridge hole/appature 137 in the opposite portion 125. The arrow shape deforms as it passes through the hole 137 and then regains its full shape after passing through the hole to prevent the bridge from withdrawn from the hole. The backs 127*a*, 127*b* of the arrow contact the outside surface of the wick in the second portion 125 adjacent the hole 137 so that the arrow head does not withdraw from the hole 137. In some embodiments, the wick has an inside diameter of about 0.5 inches, and preferably 0.555 inches, and a height of 0.4 inches.

In some embodiments, the portions 123, 125 are physically separated along 133. The adjacent edges at 133 can be located next to one another and the edges 119, 121 can be located next to each other to from the cylindrical hollow core and the wick can be held in shape by the wick sheath 120 and optionally the support ring 160.

In some embodiments, the wick perimeter is provided with two bridge holes, such as hole 137, each on opposite sides or different locations of the wick. The bridge is provided separate from the wick. The bridge has arrow head at both ends and each arrow head is inserted into one of the two bridge holes to removeably join the bridge to the wick. In some embodiments, the bridge has flat ends, instead of arrow head ends, and the flat ends are received in the corresponding bridge holes. The bridge holes may be any shaped aperture, including quadrilateral, circle, oval, slotted, and the like.

Figure 6:
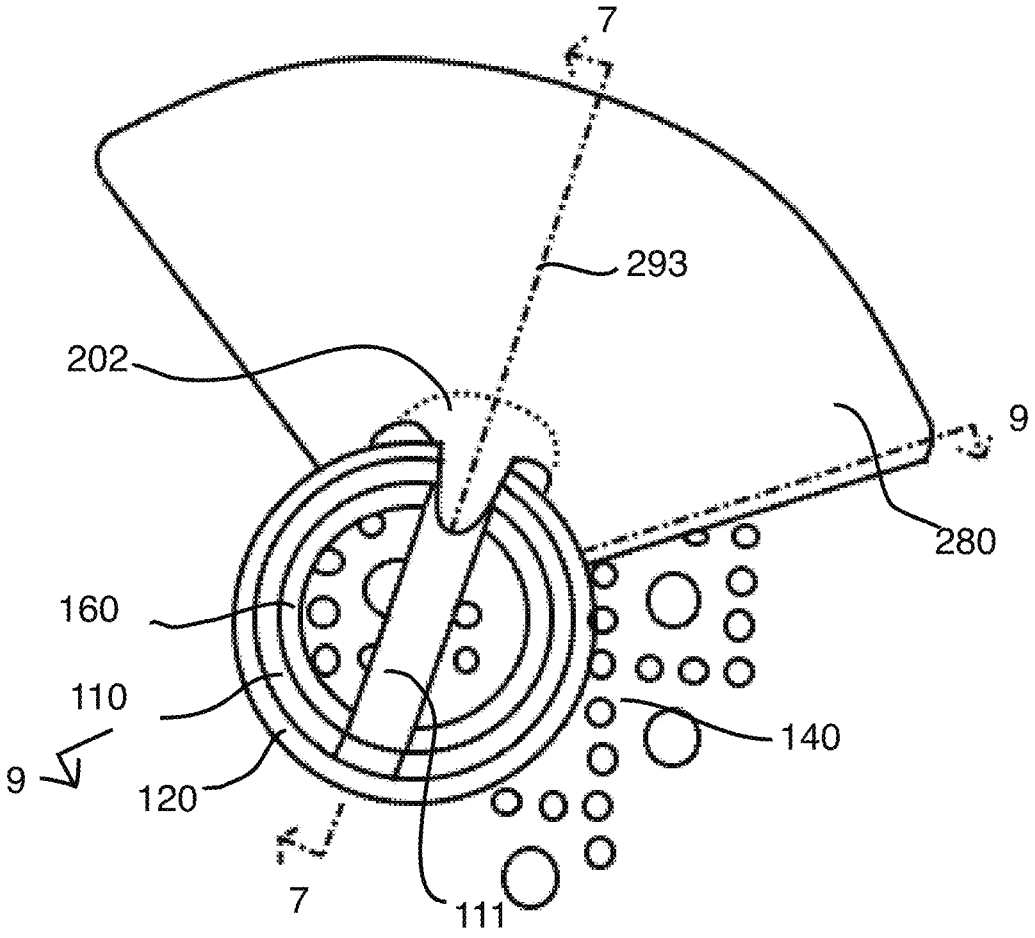
FIG. 6 is a top view of the system of FIG. 5.
Figure 6A:
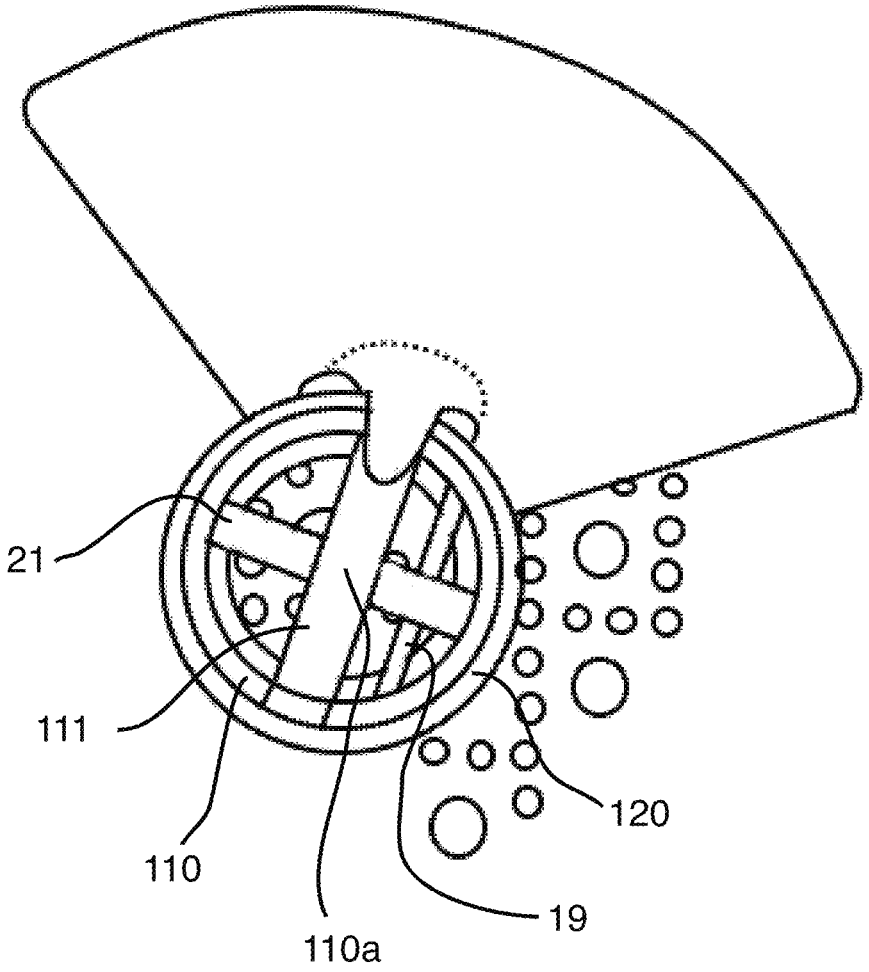
FIG. 6A is a top view of the system of FIG. 5 with multiple bridges shown.

In some embodiments, the hollow core has multiple bridges, such as shown in FIG. 6A. FIG. 6A shows the wick 110 with the first bridge 111 crossing over a second bridge 21 at a geometric center 110*a* of the wick 110. FIG. 6A also shows a third bridge 19 that is does not travel through the geometric center 110*a* of the wick and is offset from and non-crossing of the first bridge 111. In some embodiments, the third bridge 19 is parallel to the first bridge. In will be appreciated that in various embodiments, any variation of two, three, or more spaced apart side-by-side and/or crossing bridge may be used. In some embodiments, two spaced apart, non-crossing or crossing bridges may be provided so that none of the bridges pass through the geometric center of wick.

The bridge may comprise or be formed of any material which the wick perimeter is comprised of as disclosed herein. In some embodiments the bridge is formed of one type of material capable of acting as a wick and the wick perimeter is formed of another type of material capable of acting as a wick. In some embodiments the bridge and the wick perimeter are formed of the same type of material.

Figure 22A:
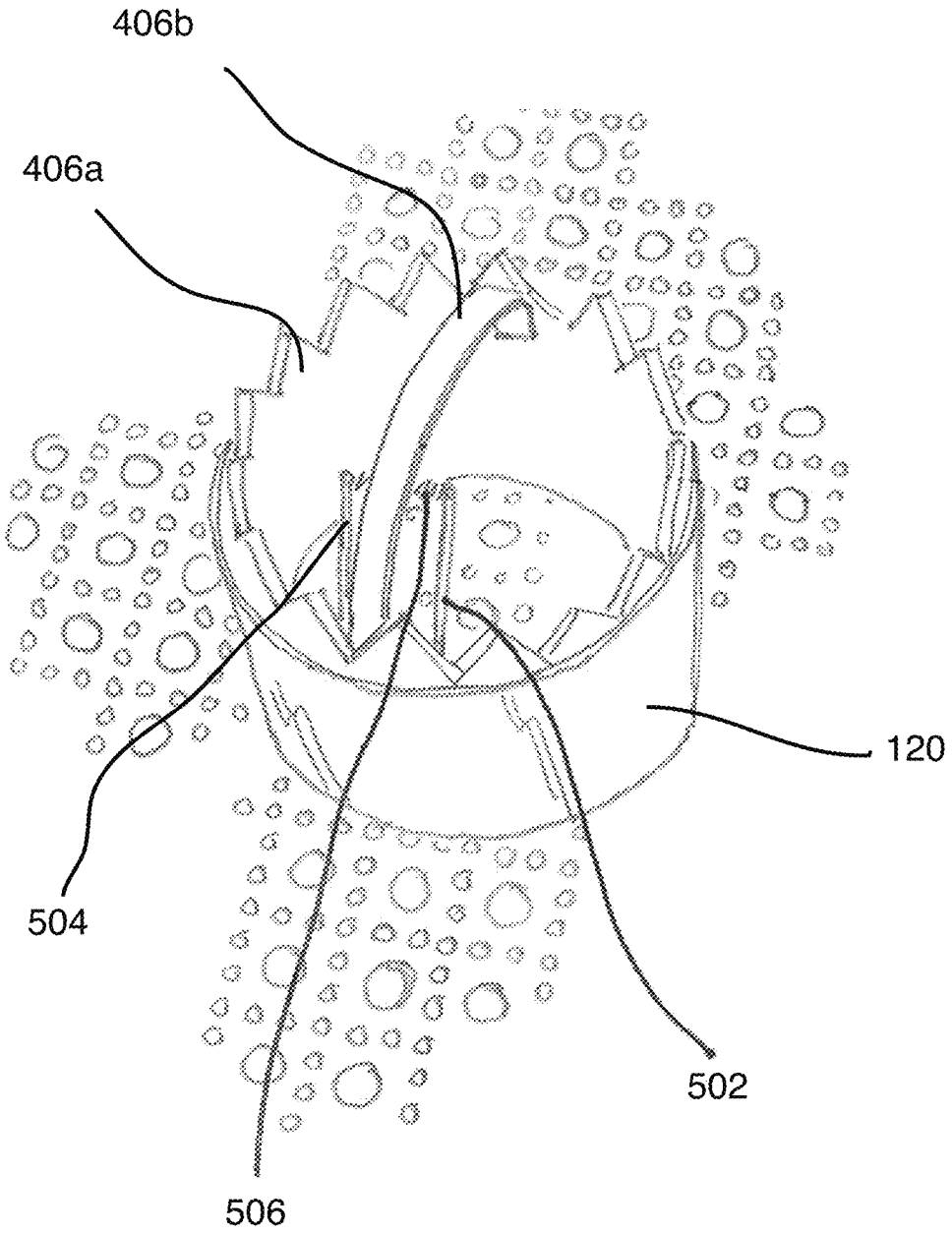
FIG. 22A is a perspective view of a third embodiment of the fuel burning system, with certain components not shown.
Figure 22B:
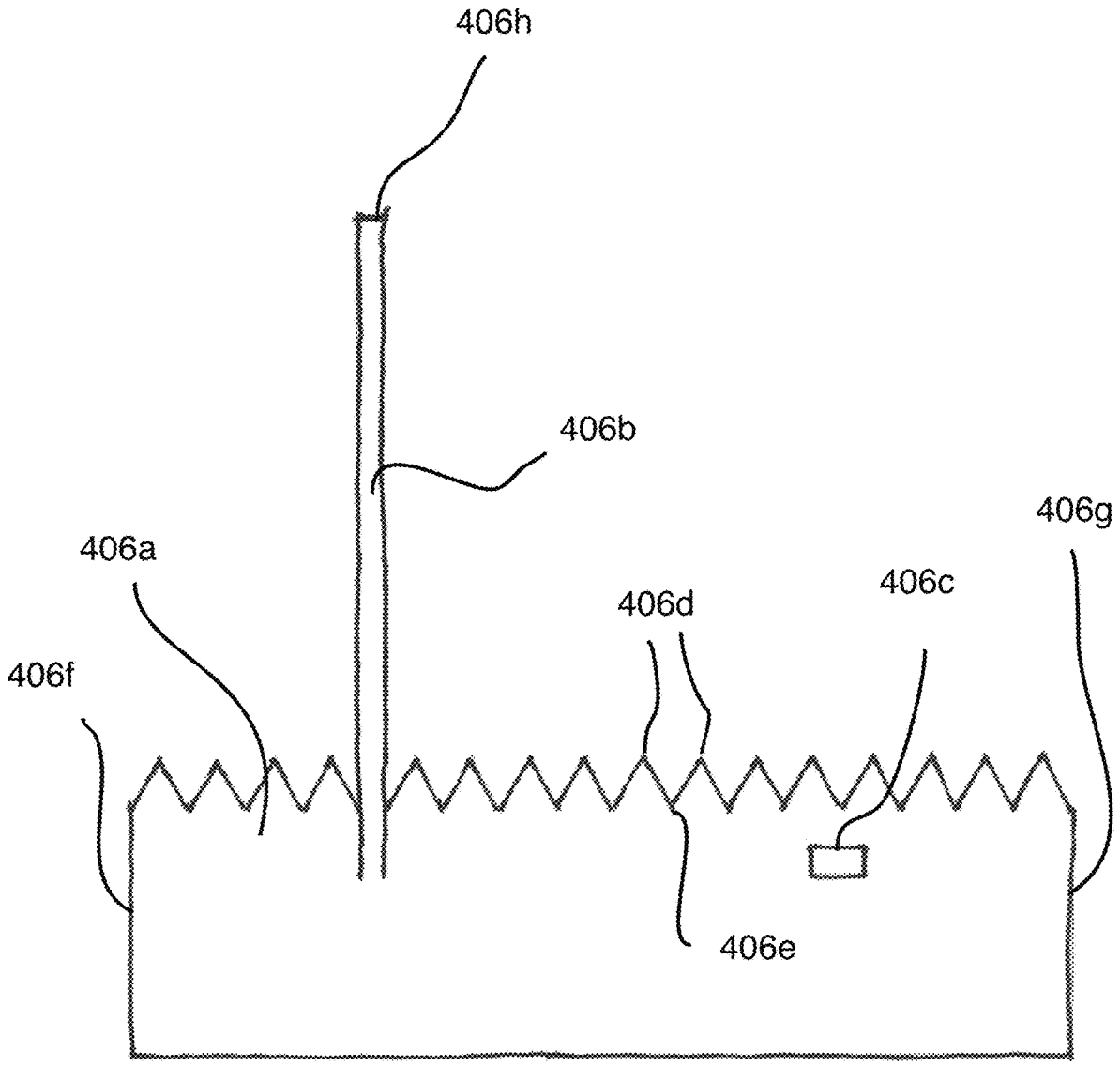
FIG. 22B is a side view of the wick of FIG. 22A shown in a flattened position.

FIGS. 22A and 22B show an alternative embodiment wick 406*a* similar to wick 400. In FIG. 22B the wick is shown flat, similar to wick 117 of FIG. 4. One or both of the opposite lateral edges 406*f*, 406*g* can be folded to the other/together to form a ring or cylinder. The wick can be held in shape by the wick sheath 120 and optionally the support ring 160. The end 406*h* of the bridge 406*b* can be inserted and retained in the bridge hole 406*c* to from the bridge as shown in FIG. 22A. The wick 406*a* has higher peaks 406*d* and closer peaks 406*d* and valleys 406*e* than the wick 400. This arrangement may be used in larger outdoor applications, such as a yard torch, a firepot, or a fire pit, where a larger flame is desired. The bridge may extend higher for such applications. In some embodiments, the center of the bridge is between ⅛ inch and 1 inch higher than the top of the peaks 406*d*. In some embodiments, the height from the bottom of the valleys 406*e* to the top of the peak

406*d* is 0.18 inch or more. Such a height allows liquid fuel inside of the burn chamber to escape, or overflow, through the area in the valleys 406*e* to outside of the wick system without extinguishing the flame on the wick at or about the peaks.

Figure 5:
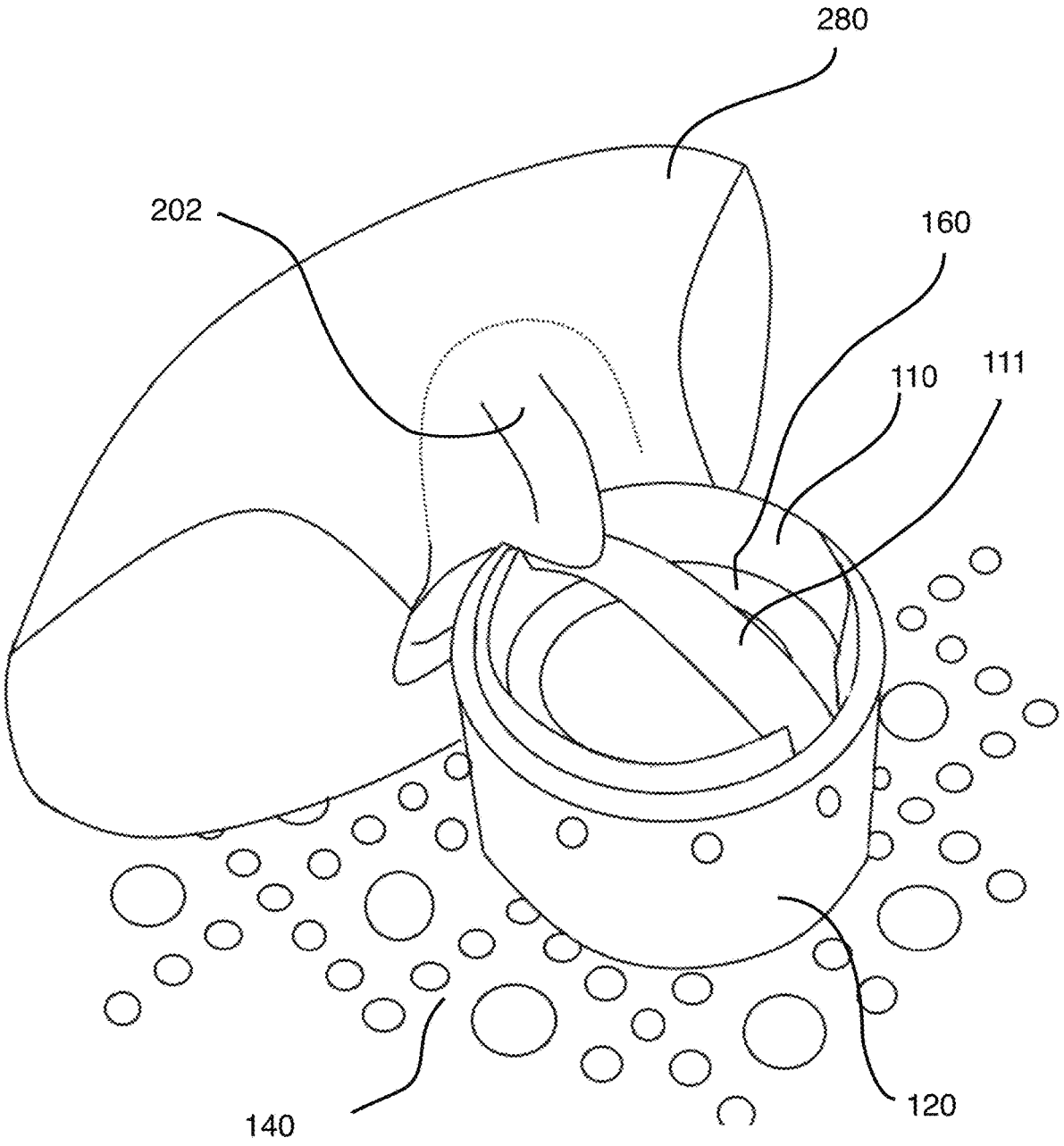
FIG. 5 is a perspective view of the system of FIG. 1 with a solid fuel shown.
Figure 36:
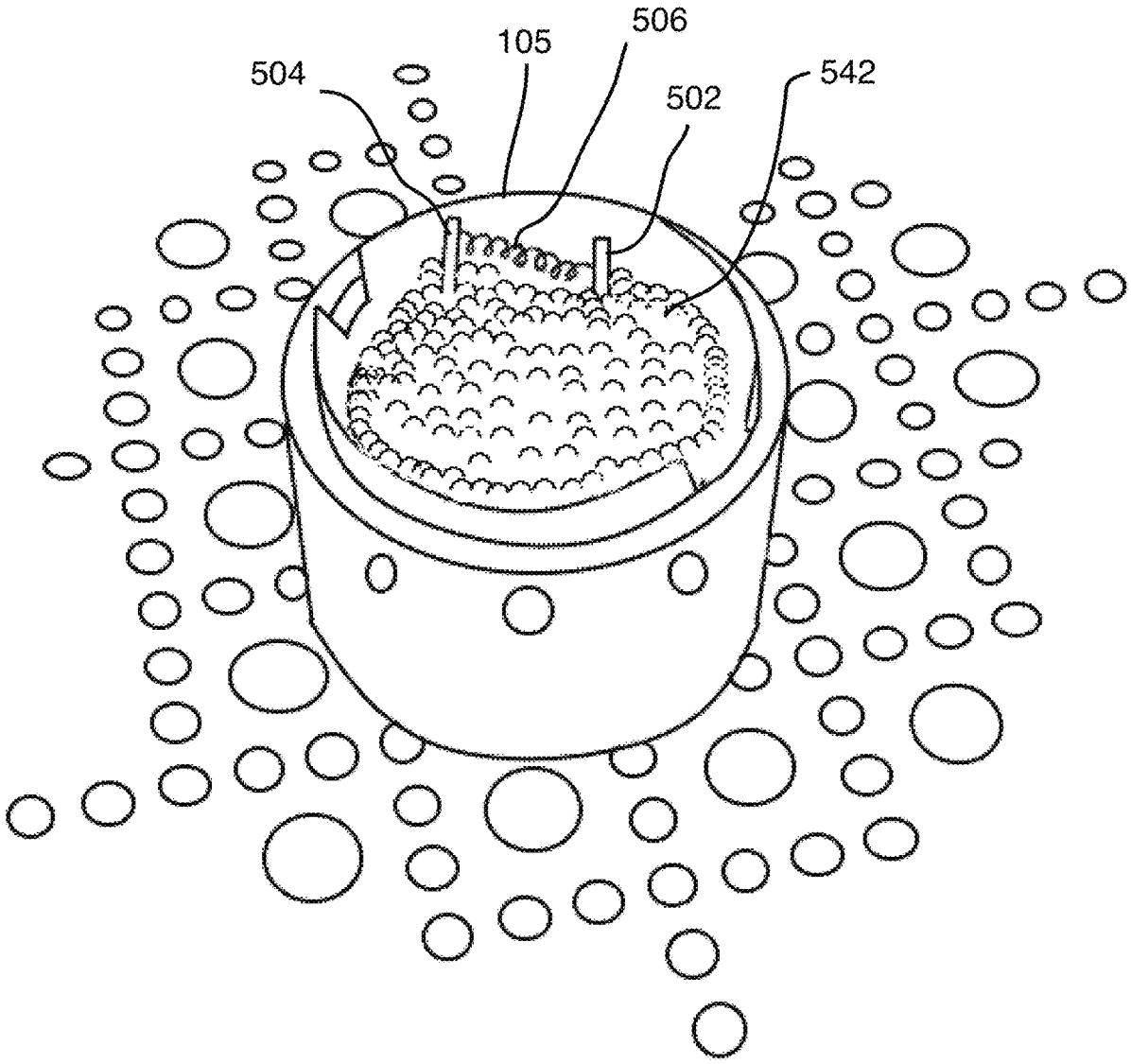
FIG. 36 is a perspective view taken from FIG. 29 with granular pourable wax shown.

Wickless Solid Fuel. The burner system 100, 200 utilizes a solid fuel 201. The solid fuel may be of a configuration as disclosed in U.S. patent application Ser. No. 13/640,478 and U.S. patent application Ser. No. 13/868,966, which are herein incorporated by reference in their entirety to the extent not inconsistent with the present disclosure. The solid fuel can be in either a pellet form, such as shown in FIG. 36, or a pre-formed solid element, such as shown in FIG. 5.

The solid fuel used by the system may be comprised of solid wax fuels, such as soy wax, palm wax, beeswax, paraffin, or other hydrocarbon fuels that are solid below 90 degrees Fahrenheit (F) and liquid above 220 F. More particularly, the solid fuel waxes used by the system may comprise those that melt when heated to temperatures in the ranges of 125 F to 180 F. The fuels usable with the burner system include not only solid fuels but also liquid fuels. Therefore, the fuel used can be any meltable solid or liquid hydrocarbon or glycol whose flash point is in excess of 180 F. Such fuels may include soy wax, palm wax, solid paraffin, liquid paraffin, olive oil, diethylene glycol, monoethylene glycol, among others.

Figure 7:
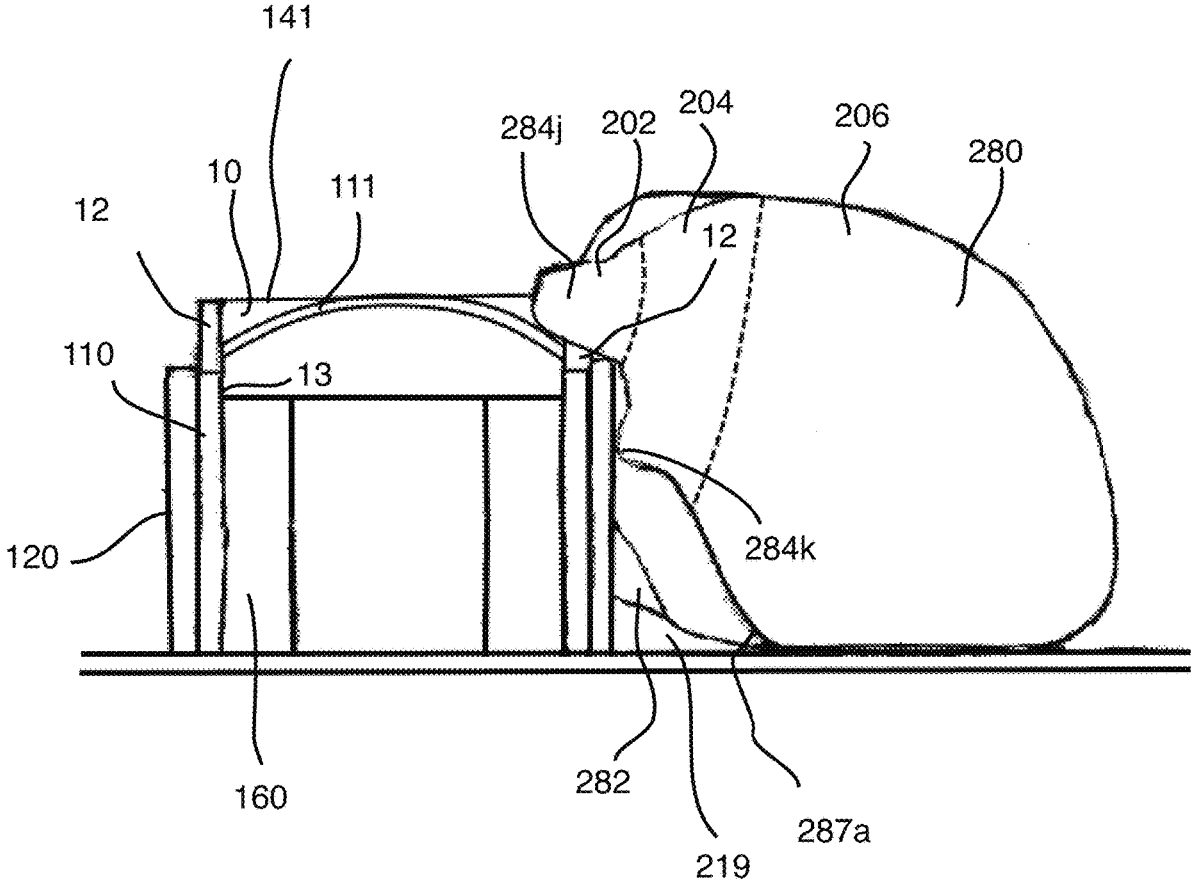
FIG. 7 is a sectional side view of the system of FIG. 6 taken along the line 7-7 of FIG. 6.

A wickless solid fuel 280 is shown in FIGS. 5-19. Referring to FIG. 7, the solid fuel comprises a priming section 202, a stoking section 204, and a main section 206. The different sections 202, 204, 206 of the solid fuel may be comprised of different fuel formulations, varying in a number of aspects including but not limited to melting point, vaporization point, oil content level, type of oil (fragrance, insect repellent, short chain hydrocarbons, medicinal ingredients, glycol, or other), and total mass.

In FIG. 7, the priming section 202 is configured to be positioned above at least a portion of the wick 110. In some embodiments, the priming section is in contact with the upper surface 141 of the wick 110. In some embodiments, the priming mass is adjacent but not directly above the wick 110.

Figure 8:
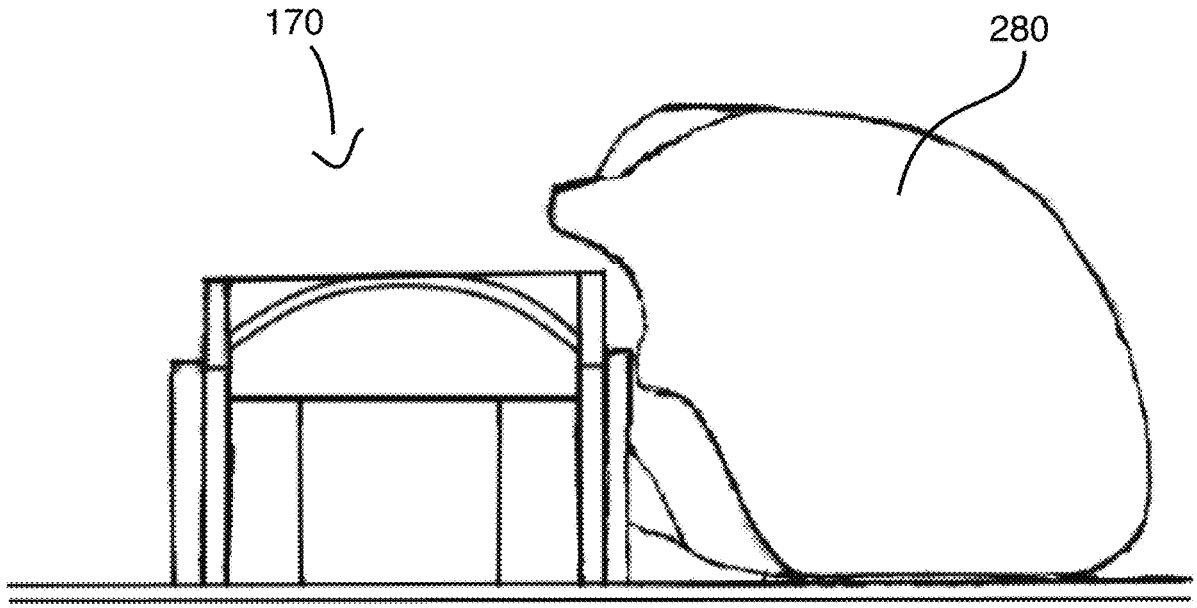
FIG. 8 is a sectional side view of embodiment of the fuel burning system taken from a view similar to that of FIG. 7.
Figure 9:
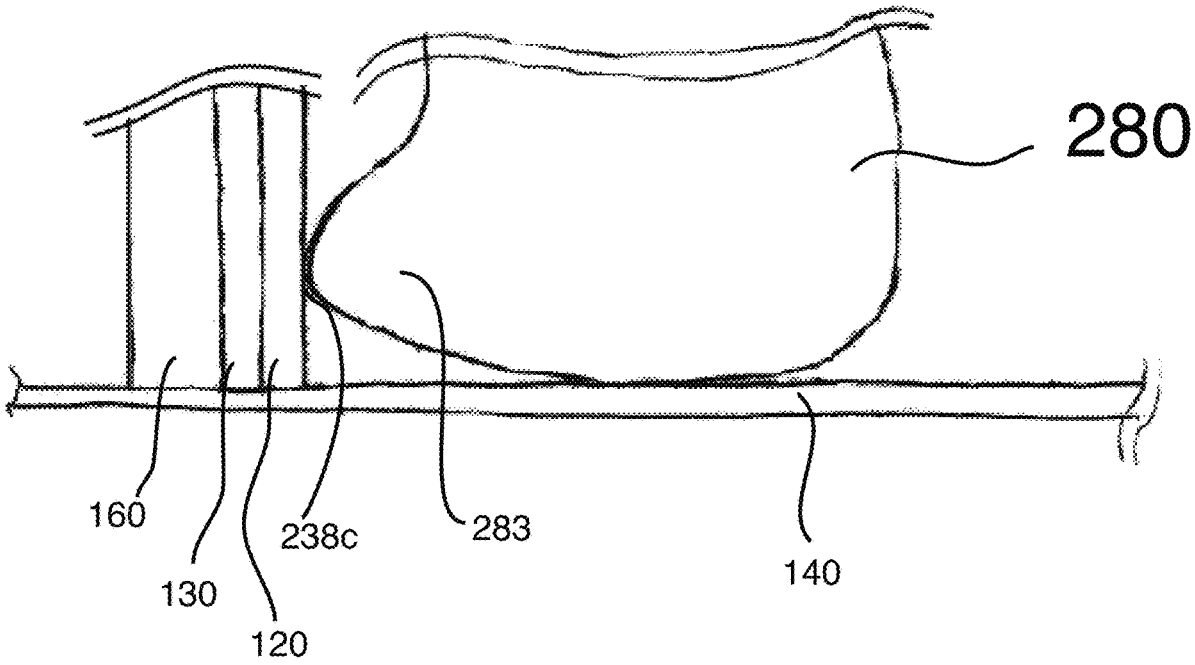
FIG. 9 is a sectional side view of the system of FIG. 6 taken along line 9-9 of FIG. 6.
Figure 11:
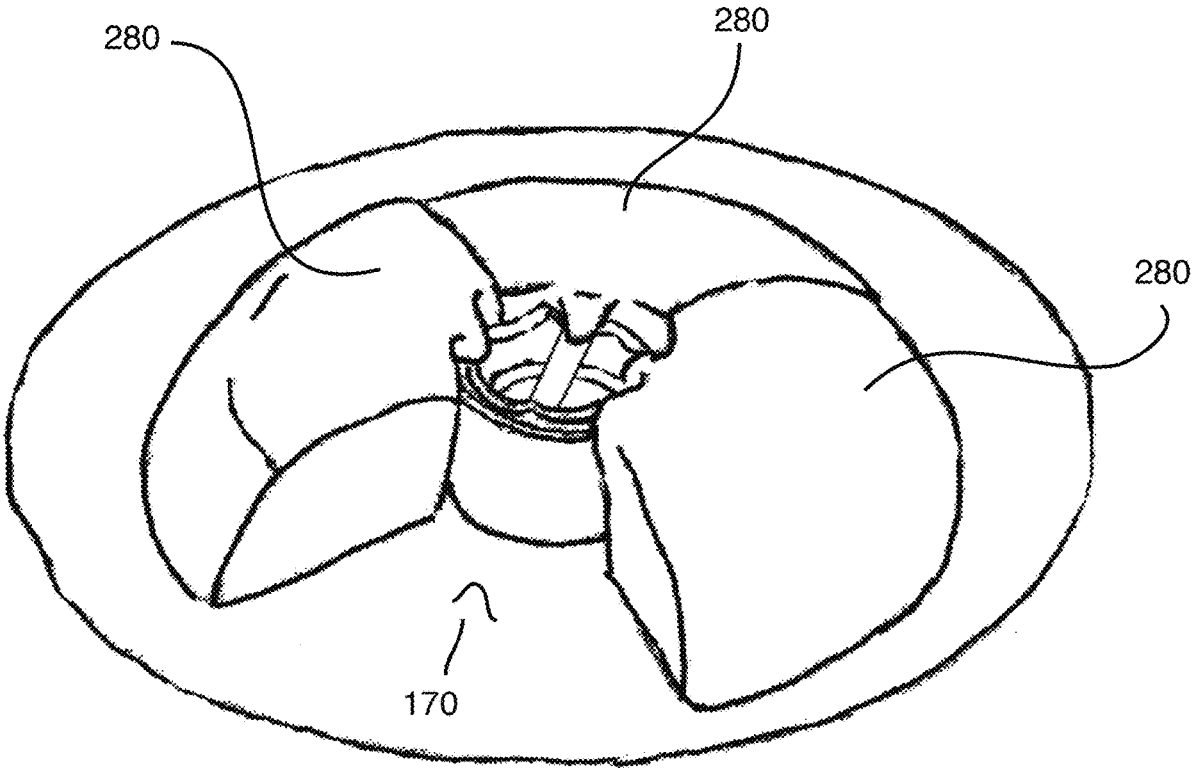
FIG. 11 is a perspective view of the system of FIG. 2 with the reservoir not shown and with multiple solid fuel units shown.

In some embodiments, the priming section is in contact with a portion of the bridge 111, such as shown in FIG. 7. In some embodiments, the priming section is spaced apart and located above a portion of the bridge, such as shown in FIG. 8. In some embodiments, the priming section protrudes through the bridge gap 12. The priming section may be located above a portion of the wick not located at the bridge, such as shown in FIG. 11.

When a portion of the priming section is located above the wick and/or the bridge, the portion of the wick or bridge below the overhanging priming section may be an ignition portion where the priming section will flow. This ignition portion is generally an upper portion of the wick or a portion of the bridge with a relatively small total mass to keep the total heat capacity at the point of ignition at a minimum. In this manner and as shown in the designs of wicks 130, 330, 340, 350, 360, 370, 390, 400 the ignition portions can be the peaks or raised portions along the wick. Likewise the raised portions of the wicks 410 and 420 may also be ignition portions. As a result, there can be multiple ignition portions about the top edge of the wick, any of which can receive the fuel from the priming section of the refill and be ignited.

The priming section is positioned so as to allow a typical igniting flame from a match or lighter to be in contact with the wick and to be close enough to melt at least a portion of the priming section. The priming section, once melted, preferentially flows toward and into the wick and/or bridge. The priming section, when melted, may fall directly on top of the wick and or bridge, and/or it may fall on to the side wall of the wick, and/or it may fall adjacent, but not directly on the wick, but then flow toward and make contact with the wick and or the bridge. The priming section has generally the smallest mass as compared to sections 204 and 206 because it, along with the wick, needs to be elevated to ignition temperature quickly by the flame. A larger mass will take longer to melt and provide fuel to the wick. Therefore the priming section enables an accelerated flame start time at the wick. The priming section is sized to balance, during ignition, between not enough fuel to ignite the wick and not too much melted fuel so as to avoid flooding the wick.

The priming section may be initially melted by the ignition source, such as a match, lighter, a filament, or other flame source, before the flame begins on the wick. Once the flame begins on the wick and the ignition source is removed the flame on the wick will continue to melt the priming section. In some embodiments, the priming section, when melted by the ignition source, will flow directly to the portion of the wick that will first be ignited which is generally at or adjacent the placement of the ignition source.

When the priming section is placed on or above the bridge, the priming section interfaces with the bridge by contact or by melting wax from priming section falling on the bridge to prime the bridge or a portion of the bridge, which is then easily and quickly ignited giving the bridges smaller mass and surface area compared to the mass and surface area of the perimeter of the wick. The bridge then develops a flame that melts more wax to prime the totality of the wick 110 by flowing from the priming section to and along the bridge and to and on the outside perimeter of the wick adjacent the priming section. The flame transfers from the bridge to the perimeter of the wick and the flame is fully developed on and about the wick.

Igniting at the bridge results in a reduction in the time to prime and ignite a flame on the wick so that the flame is burning on the wick without further assistance of a starter flame, such as from a match or an external flame source. At least one test has shown an ignition time that is 7 to 15 second faster that if a bridge is not used on a hollow core wick. Ignition has been achieved in less than 8 seconds. Some tests show that a hollow core wick can take 15-24 seconds to light without a bridge but using a bridge on the same hollow core wick reduces the ignition time to 8 seconds or less.

Further, the use of a bridge for initial igniting maintained the reduction in priming and ignition time with consecutive ignitions and uses of the reusable hollow core wick. Some prior art techniques without a bridge show an increase in ignition times with repeated use. With one configuration of a hollow core wick with a bridge, ignition times averaged less than 7 seconds for 100 uses and whose range stayed consistently between 5 and 10 seconds throughout the 100 trials.

Another advantage of the bridge is a lower overall operating flame height of less than 1.25 inches with one embodiment of the hollow core wick with a bridge. In certain versions not having a bridge the operating flame heights were between 1.5 and 2.5 inches. Lower flame heights, while possible with previous wick designs, required excessive ignition times and provided difficulty in ignition times, particularly with repeated uses.

In some embodiments, the priming section has a mass in the range of 0.01 grams to 0.5 grams and hangs over the top of the wick in such a manner that when the fuel melts, the resulting flow creates one or more drops of fuel that prime the wick. In some embodiments, the priming section has a mass of 0.5 grams or less.

The stoking section 204 is close enough to be melted primarily from heat radiation by the newly ignited flame at the wick and is generally of larger size than the priming section 202 because it needs to supply the fuel to wet the totality of the wick so that the full flame may develop. Unlike the priming mass, however, the stoking section needs to flow primarily away from the flame and toward the bottom portion of the wick otherwise the wick or flame may become flooded. Therefore the stoking section is positioned close enough to the flame to melt the fuel via radiating heat but far enough away to make sure the melting wax does not flow into the flame and flood the wick. A flooded wick would result in very slow flame development or may extinguish the flame. Flow channels, such as flow paths B and C of FIG. 19, may be provided to route melting wax so that it does not flood the flame The melted stoking mass flows away from the ignited section of the wick and down toward the base of the wick system, entering the wick system 170 from the bottom, and wetting the wick from the bottom. This feeding of the wick from the bottom stokes the flame as it develops more fully. In this manner, the newly ignited flame is not at risk of flooding and will not starve itself of fuel since the melted fuel is delivered quickly to the wick system 170.

The function of the stoking section is to fully develop the flame and increase the system operating temperature above that of the melt point of the solid fuel. The stoking section must be of sufficient mass to allow the flame to burn until the system reaches the desired melting temperature. If not, the system will be starved of liquid fuel and the ignited flame will go out leaving a solid mass of wax fuel behind. The stoking section must also be designed in such a way as to avoid flooding the wick at or near the ignition area. This is done by creating a physical design of the stoking section and its placement relative to the wick system that allows the melted fuel of the stoking section to flow to the wick either beneath the ignited portion of the wick or to the side of the ignited portion of the wick.

In some embodiments, the stoking section has a mass in the range of 0.25 grams to 2.5 grams. In some embodiments, the stoking section has a mass greater than 0.24 grams and less than 3 grams. In some embodiments, the stoking section has a mass that is 5 times the mass of the priming section. In some embodiments, the stoking section has a mass that is 25 times the mass of the priming section. In some embodiments, the stoking section has a mass that is in the range of 5 to 2500 times the size of the priming section.

The main section 206 is the largest of the three sections 202, 204, 206. The main section provides the bulk of the fuel that is melted primarily from conductive heat. Conductive heat is transferred from the flame through the wick sheath to the melting grate to the main section 206 in contact with the melting grate and within a radiating distance there from. Main section may also be heated through radiant heat transferred through ambient air from the flame at the wick. The main section provides a continuous supply of melted fuel to the base of the wick system to be drawn in and combusted in the burn chamber of the wick system 170 until the fuel in the lower fuel reservoir area 158 is exhausted. The main section is generally the furthest section from the flame and wick.

The main section has a mass that is sized depending on the desired total burn time of the system without a refill as well as the size of the melting grate 140 and/or the reservoir 150. In some embodiments, the main section has a mass in the range of 3 grams to 25 grams. In some embodiments, the main section has a mass in excess of 25 grams.

In some embodiments, the main section has a mass that is 10 times the mass of the stoking section. In some embodiments, the stoking section has a mass that is 12 times the mass of the stoking section. In some embodiments, the stoking section has a mass that is greater or equal to 10 times the size of the stoking section.

The solid fuel 280 may be configured, when placed adjacent other solid fuel as shown in FIG. 11, to form a completely surrounding fuel configuration about the wick system 170. FIG. 11 shows one solid fuel missing so that the wick system 170 is visible.

When the solid fuel 280 is positioned adjacent the reusable wick, the nature of the geometry of the solid fuel will manage the igniting, forming, and maintaining the desired flame. Upon placing a match, lighter, or other igniting element close to the point where the solid fuel touches or is adjacent the wick, the heat from the ignition source melts the relatively small amount of wax that then flows toward and into the wick from the top of the wick system. When not igniting at the bridge, because the total mass of the priming section fuel combined with the wick is small relative to the mass of the full wick filled with fuel, the ignition flame then can elevate the collective mass of the of the full wick and melted fuel to its ignition temperature and the system is primed. When igniting at the bridge, because the total mass of the priming section fuel combined with the bridge is small relative to the mass of the full wick filled with fuel, the ignition flame then can elevate the collective mass of the of the full wick and melted fuel to its ignition temperature and the system is primed.

Once the wick is ignited, the flame then melts through the remainder of the priming section and into the stoking section 204 of the wickless refill through radiating heat from the flame though the ambient air. However, rather than drawing the newly melted fuel directly into the flame, this section of melting fuel runs away from the flame and toward the bottom end of the wick, seeking to fully replenish the wick with melted fuel without restricting or flooding the developing flame at the top. The spacing of the stoking section from the wick system 170 should be such as to allow space for the newly melted wax to flow so that it does not flow down onto the flame. The wax melting from the stoking section generally, during at least a portion of the melting of the stoking section, travels down the exterior of the wick sheath that itself is beginning to be heated by the flame above. As the melted wax begins to fill or saturate the bottom of the wick, it enables the full development of the desired flame.

As the larger and more fully developed flame grows fed by fuel from the stoking section, the main section 206 begins to melt via conductive heating. The main section 206 is larger and comprises more mass than the stoking section or the priming section. The main section continues to supply/replenish the fuel within the wick from the bottom portion of the wick until the total mass of all fuel is exhausted and the flame is extinguished. When the flame runs out of fuel and is extinguished it will leave behind a dry wick ready to be used by another wickless wax refill.

Numerous geometries might be utilized to prime the wick by moving a relatively small amount of fuel to the point of ignition, to stoke the flame by moving more fuel away from the flame and toward the bottom of the wick, and to supply and replenish the reservoir 150.

Figure 10:
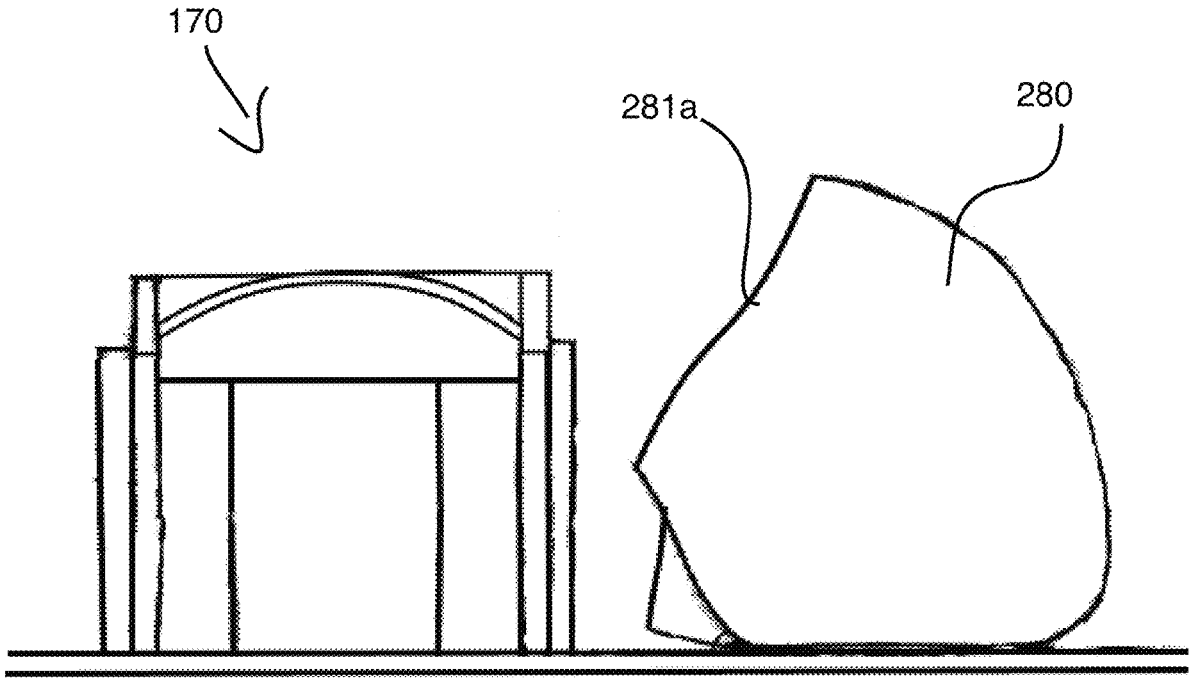
FIG. 10 is a sectional side view from FIG. 7 with the solid fuel partially melted.

FIG. 10 shows that the upper portion of the solid fuel 280 has been melted. The upper portion will melt more quickly than the lower portion, as shown along sloped section 281*a* because the upper portion is in closer proximity to the flame during initial burning. Therefore the diagonal nature of the stoking section 204 as shown in FIG. 7 is due to the fact that the heat from the flame will melt the upper portion of the solid fuel earlier in the burning process.

Figure 12:
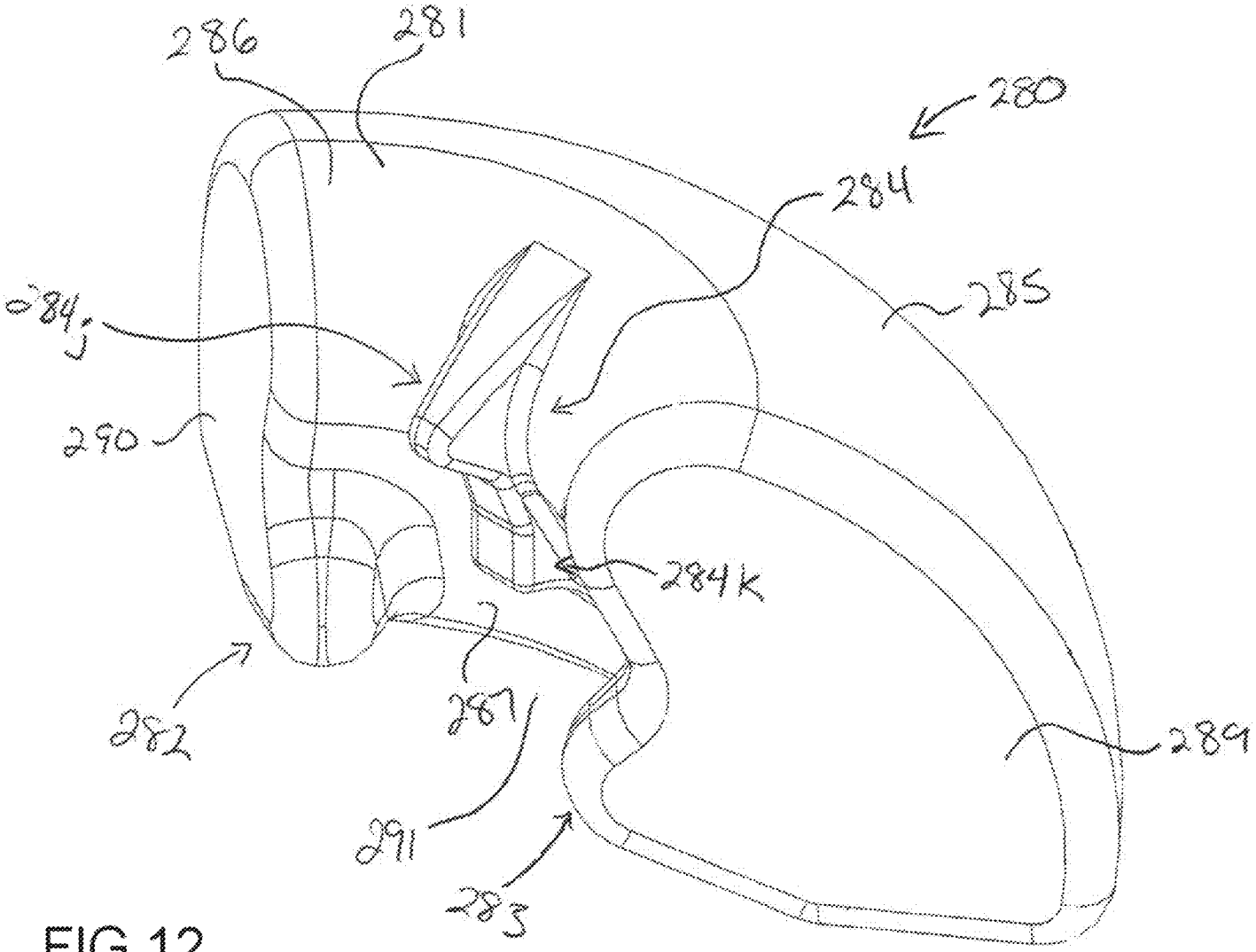
FIG. 12 is a detailed perspective view of the solid fuel of FIG. 5.
Figure 13:
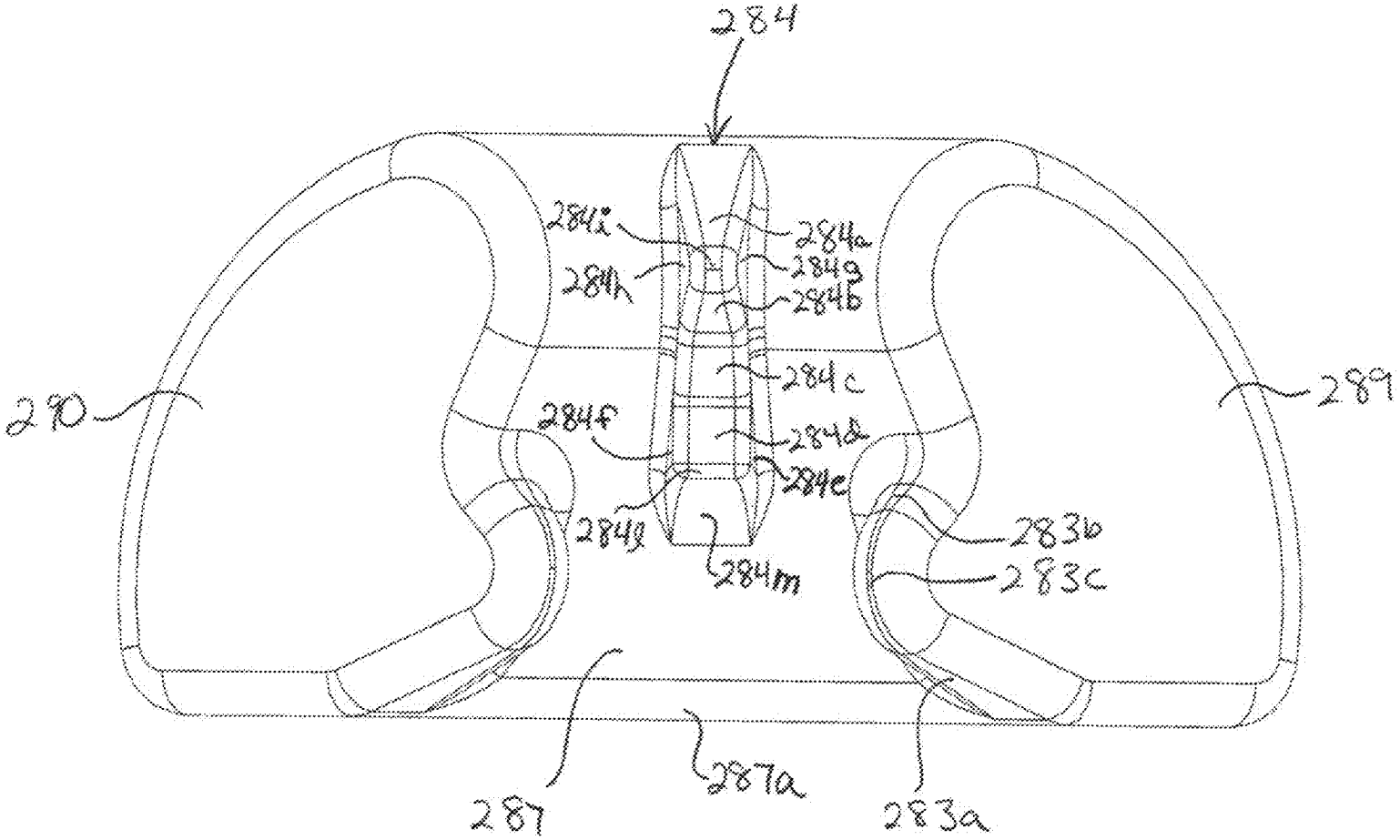
FIG. 13 is a front view of the solid fuel of FIG. 12.
Figure 14:
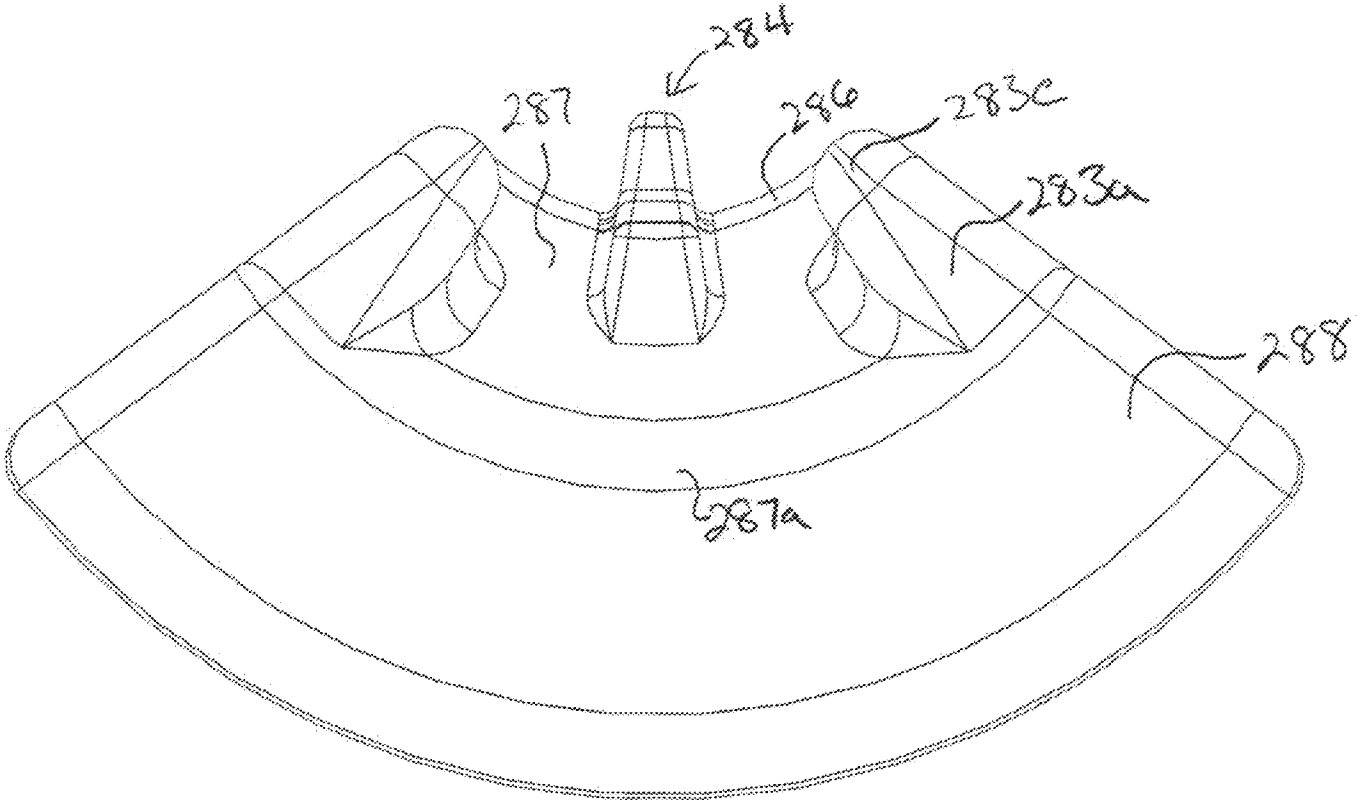
FIG. 14 is a bottom view of the solid fuel of FIG. 12.

FIGS. 12-19 show the solid fuel 280 in more detail. The solid fuel has a body 281, arms 282, 283, and a main protruding section 284. The body 281 has a back wall 285, an upper front wall 286, a lower front wall 287, a bottom wall 288, a left side wall 289, a right side wall 290. The back wall joins with the upper front wall, and the front wall joins with the bottom wall. The left and right side walls define the radial ends of the solid fuel. Each of the walls may meet a corresponding other at a curved joints as shown in FIGS. 12-14.

The main protruding 284 has an upper protruding section 284*j* comprising a first forwardly extending portion 284*a* and a second forwardly extending portion 284*b* joining the first forwardly extending portion 284*a* at a curved nose section 284*i*. The upper protruding section 284*j* has opposite inwardly converging sidewalls 284*g*, 284*h*. Below the upper protruding section 284*j* is a mid section having a first facing surface 284*c*. Below the mid section, is a lower section 284*k* having a first front wall 284*d*, and a first lower wall 284*m*. The first lower wall 284*m* extends from the body 281. The first front wall 284*d* meets the first lower wall 284*m* at a curved intersection 284*l*. The lower section 284*k* has opposite side walls 284*e*, 284*f*. The main protruding section may be located at the midpoint between the side walls 289, 290.

The lower front wall 287 curves inward to create an open pool space 291 between the body adjacent and between the arms 282, 283. This pool space allows melting wax to gather between the body and the wick sheath to continue fueling the wick without flooding the wick. If open pool space 291 forming a gap 219 between the bottom 287*a* of the lower front wall 287 did not exist, the wax may flood the wick and extinguish the flame.

The solid fuel 280 is formed so when the arms contact the wick sheath the upper protruding section 284*j* is properly positioned above the wick. Therefore, melted wax from the priming section, which includes the portion of curved nose section 284*i* that extends over the wick, can fall on the wick and initiate ignition of the wick. Further the arms ensure there this is sufficient space within the pool space 291 for wax from the stoking section to flow down the solid fuel and to the base of the wick sheath to fuel the wick from the bottom. In some embodiments, the gap 219 between bottom 287*a* of the lower front wall 287 and the wick sheath is 0.125 inches at the bisecting vertical midline 293.

Figure 15:
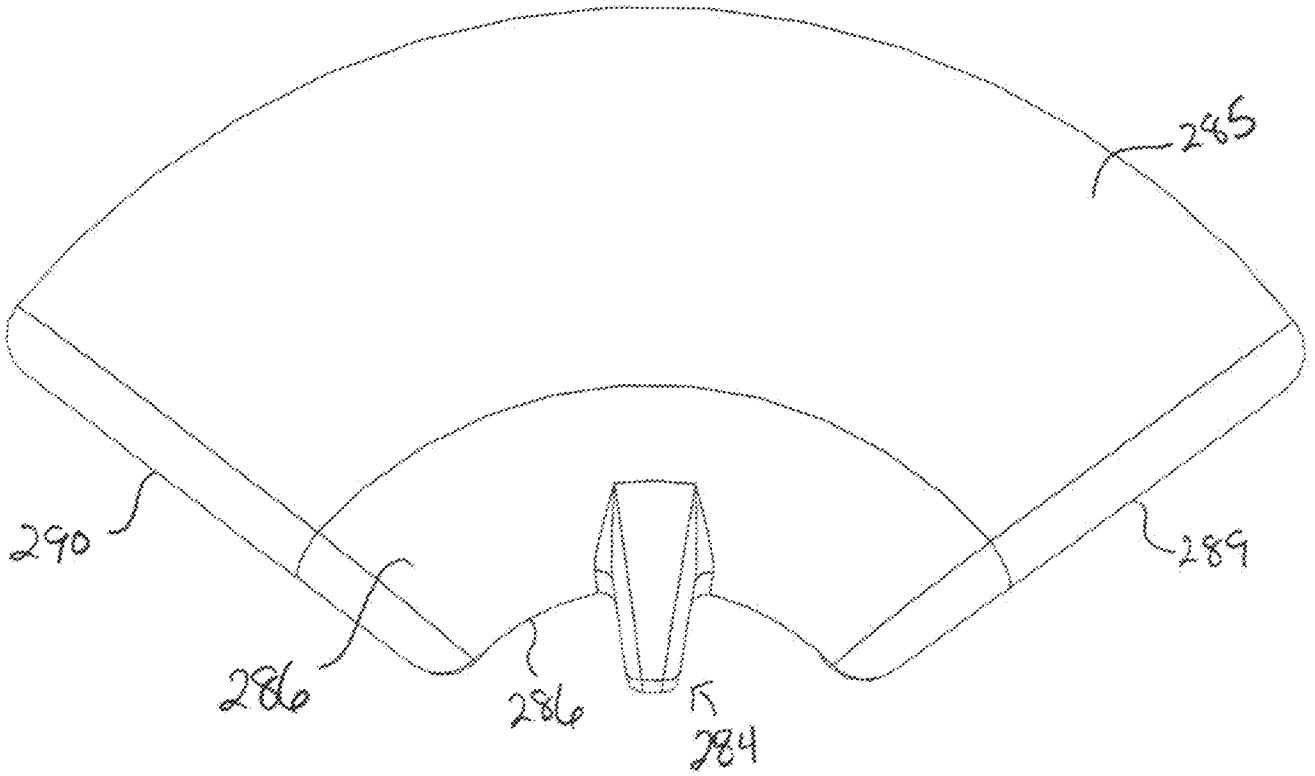
FIG. 15 is a top view of the solid fuel of FIG. 12.
Figure 16:
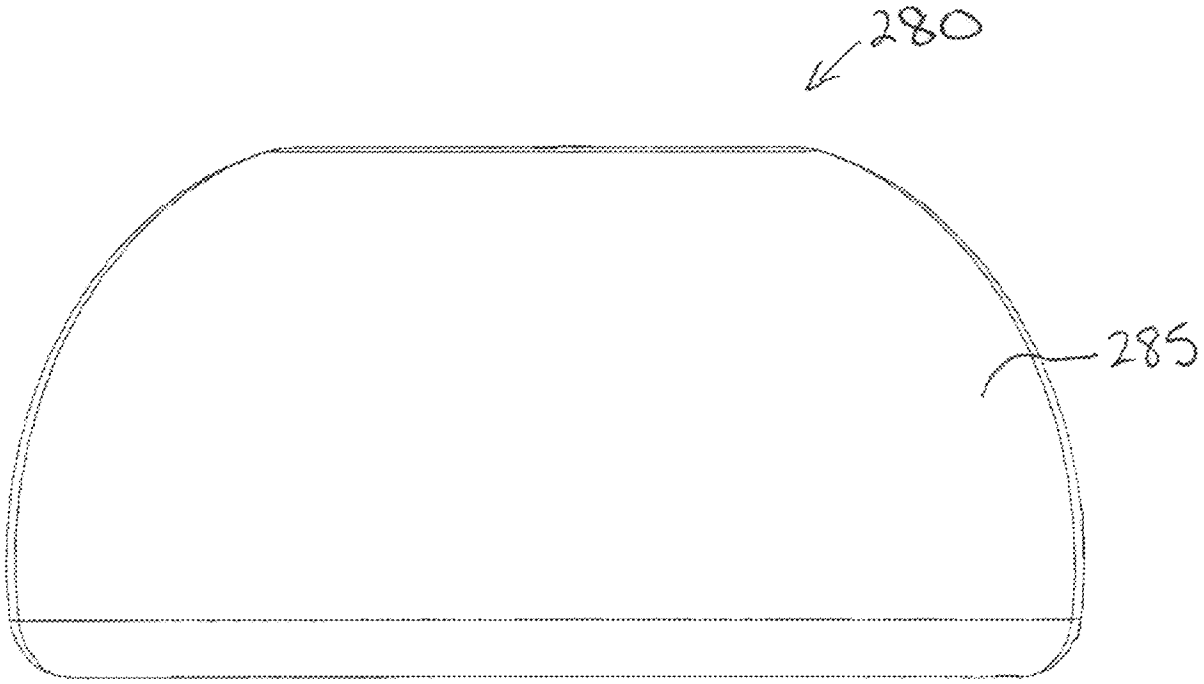
FIG. 16 is a rear view of the solid fuel of FIG. 12.
Figure 17:
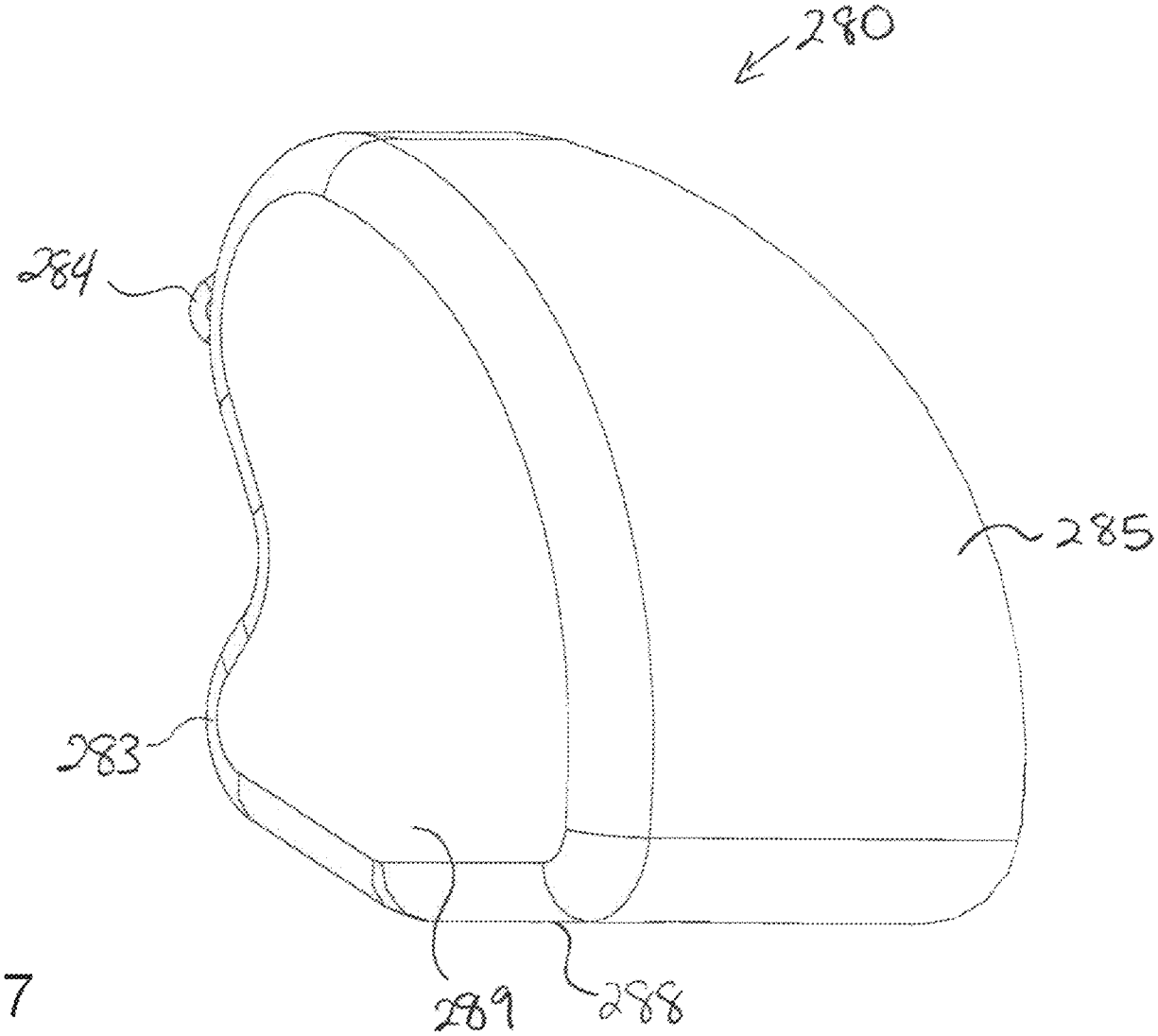
FIG. 17 is a left side view of the solid fuel of FIG. 12.
Figure 18:
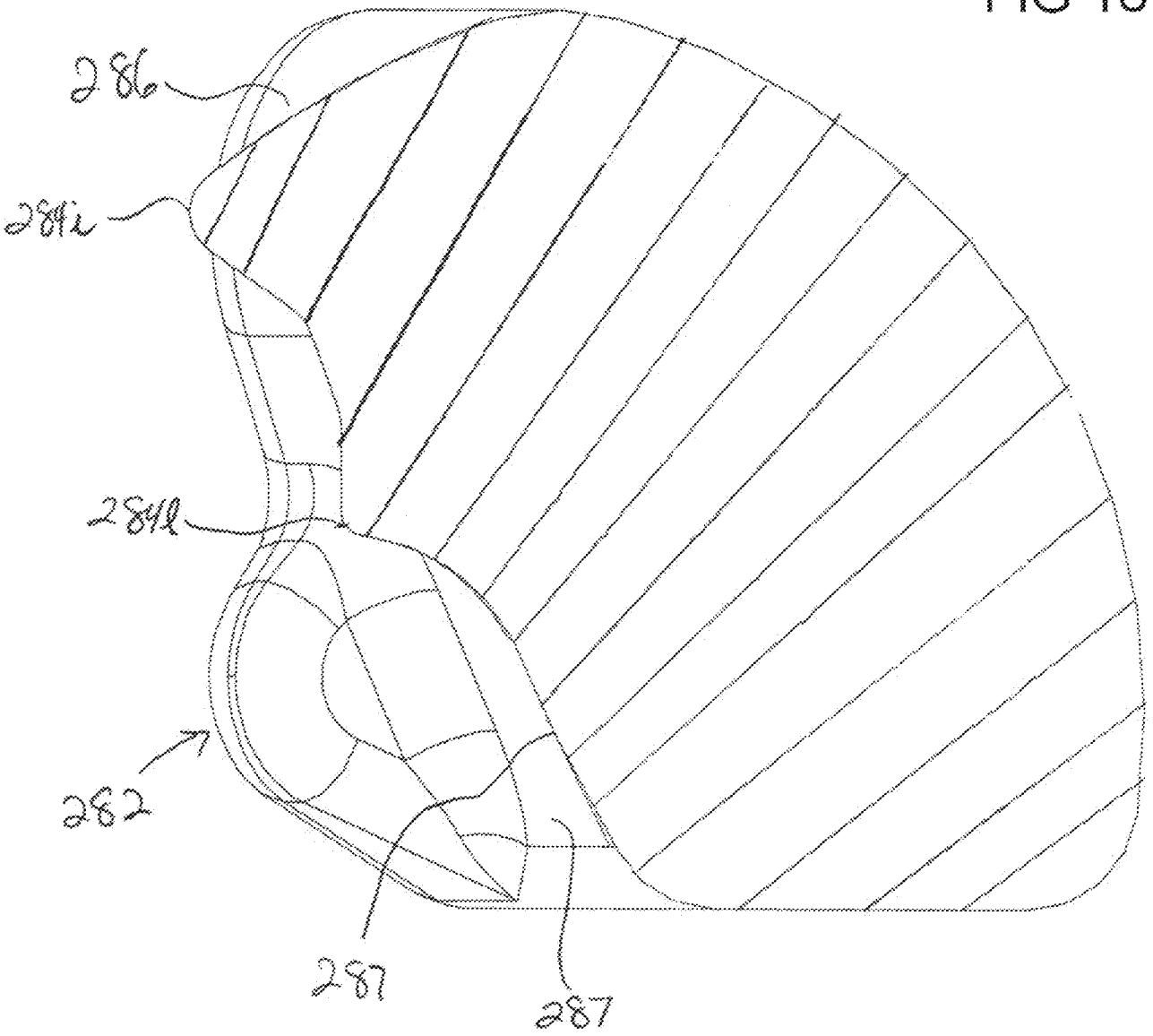
FIG. 18 is a sectional side view of the solid fuel of FIG. 12 taken along line 7-7 of FIG. 6.

Each of the arms are mirror image identical about the bisecting vertical midline 293. Therefore only arm 283 will be described. The arm has a rising bottom section 283*a*, which meets the upper portion 238*b* at a curved end 283*c*. As shown in FIG. 15, the curved end 283*c* does not extend substantially beyond the forward most portion of the upper front wall 286. In some embodiments, the curved end 283*c* is co-planer with the forward most portion of the upper front wall 286. The arms rise above the lower most bottom 288 as the arms extend away from the body.

Figure 19:
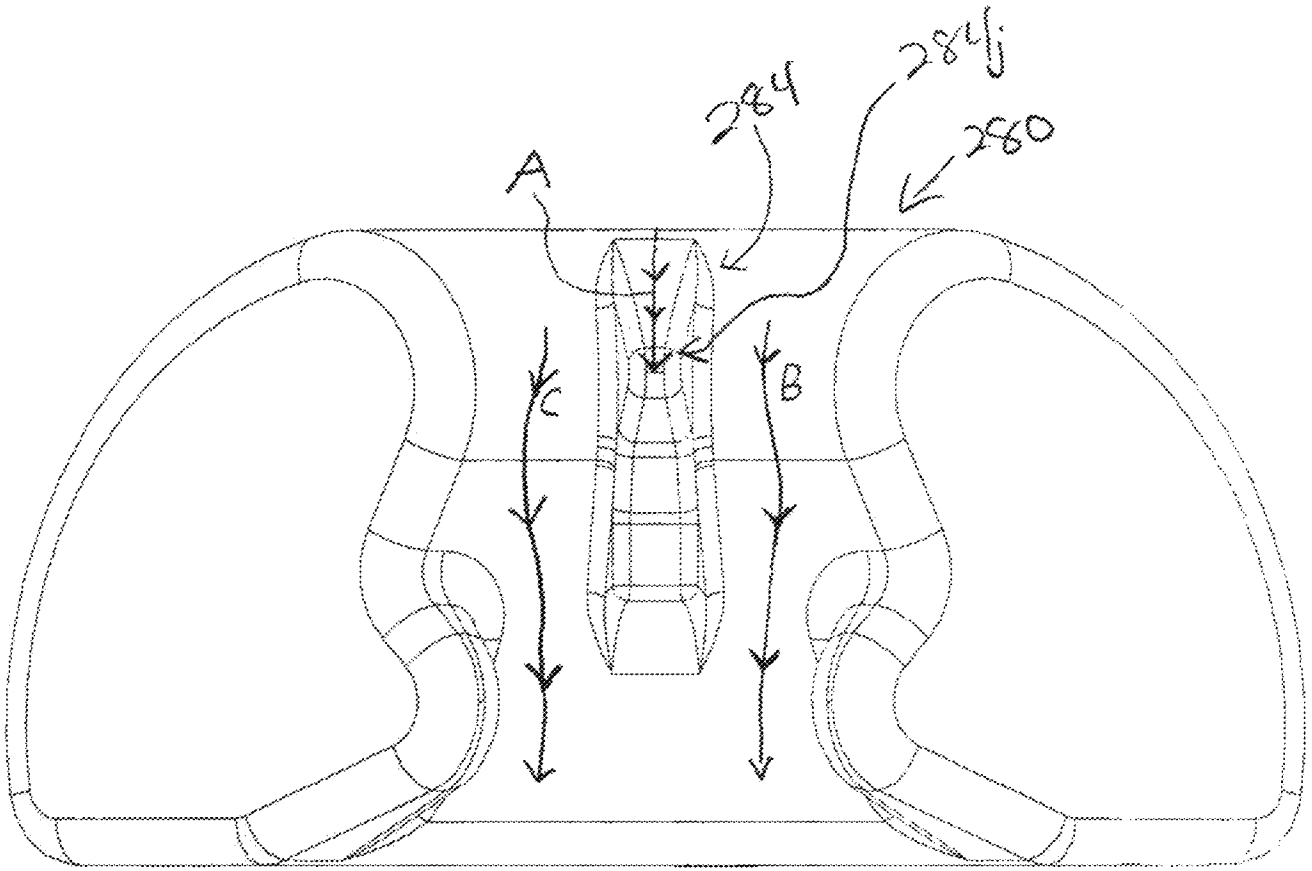
FIG. 19 is a front view of the solid fuel of FIG. 12.

In some embodiments, the lower section 284*k* and/or the mid section having a first facing surface 284*c* are configured to contact the wick sheath, as shown in FIG. 7, when the upper protruding section 284*j* is properly positioned above the wick. Therefore the lower section 284*k* and/or the mid section together with the arms create three points of contact between the solid fuel and the wick sheath that properly position the solid fuel and the priming section relative to the wick. FIG. 19 shows a lower portion of the end of the solid fuel 280 with the arm 283 in contact with the wick sheath.

FIG. 19 shows a number of flow paths along which melted wax may flow when heated by the heat generated from the flame on the wick system 170. A priming flow path A delivers melted fuel directly to the top of the wick or the bridge or both. The melted wax moving along priming flow path A will fall off of the upper protruding section 284*j* onto the top of the wick unit the upper protruding section 284*j* has melted to the extent that it no longer extends over the top of the wick or bridge or both. Stoking flow paths B and C deliver melted wax to the open pool space 291 where it will flow to the bottom of the wick sheath and be absorbed into the bottom of the wick.

In some embodiments, the wick sheath is not welded or sealed to the melting grate along its entire circumference and as the wax becomes more easily flowing through higher temperatures, some wax will flow between the melting grate and the bottom of the wick sheath and into the bottom of the wick without falling through the melting grate and into the reservoir. As the wax begins to melt, it may be slow flowing wax that will not immediately fall through the holes in the melting grate. Therefore wax will pool on the surface of the melting grate in the gap 219 during initial burning.

Figure 20:
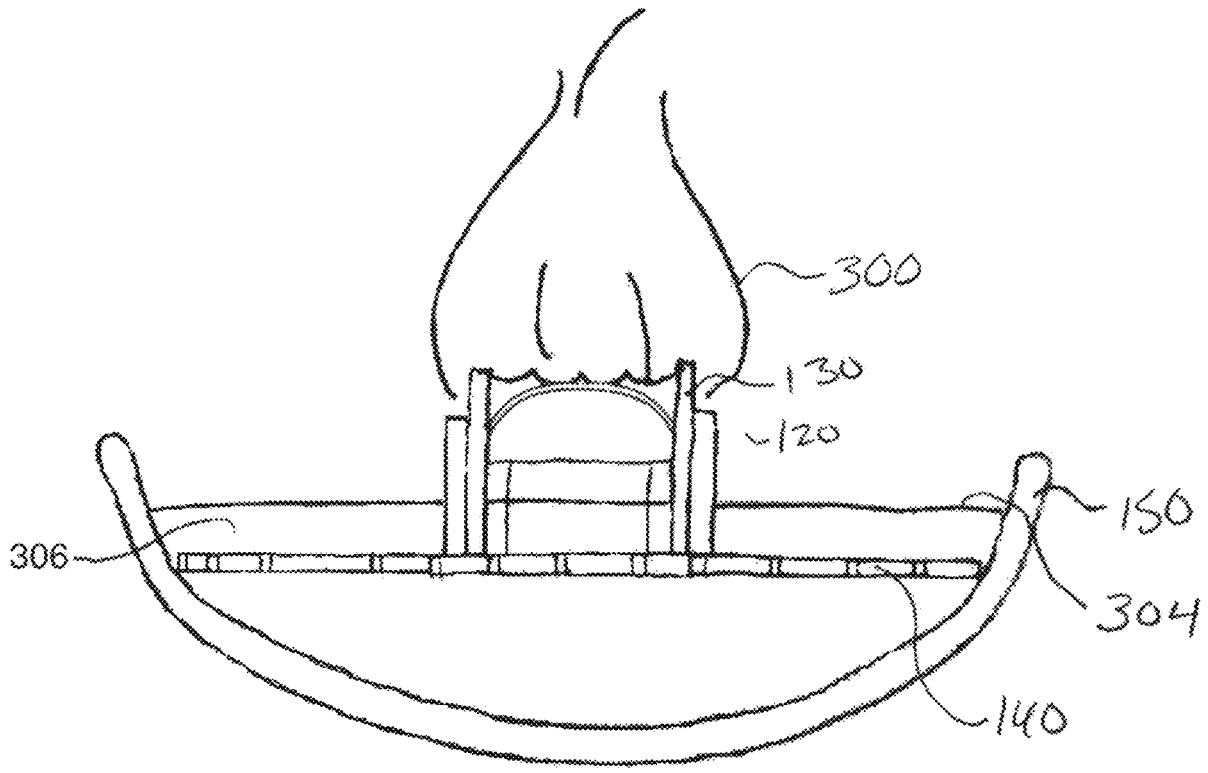
FIG. 20 is a side view of a portion of the fuel burning system of FIG. 2.
Figure 21:
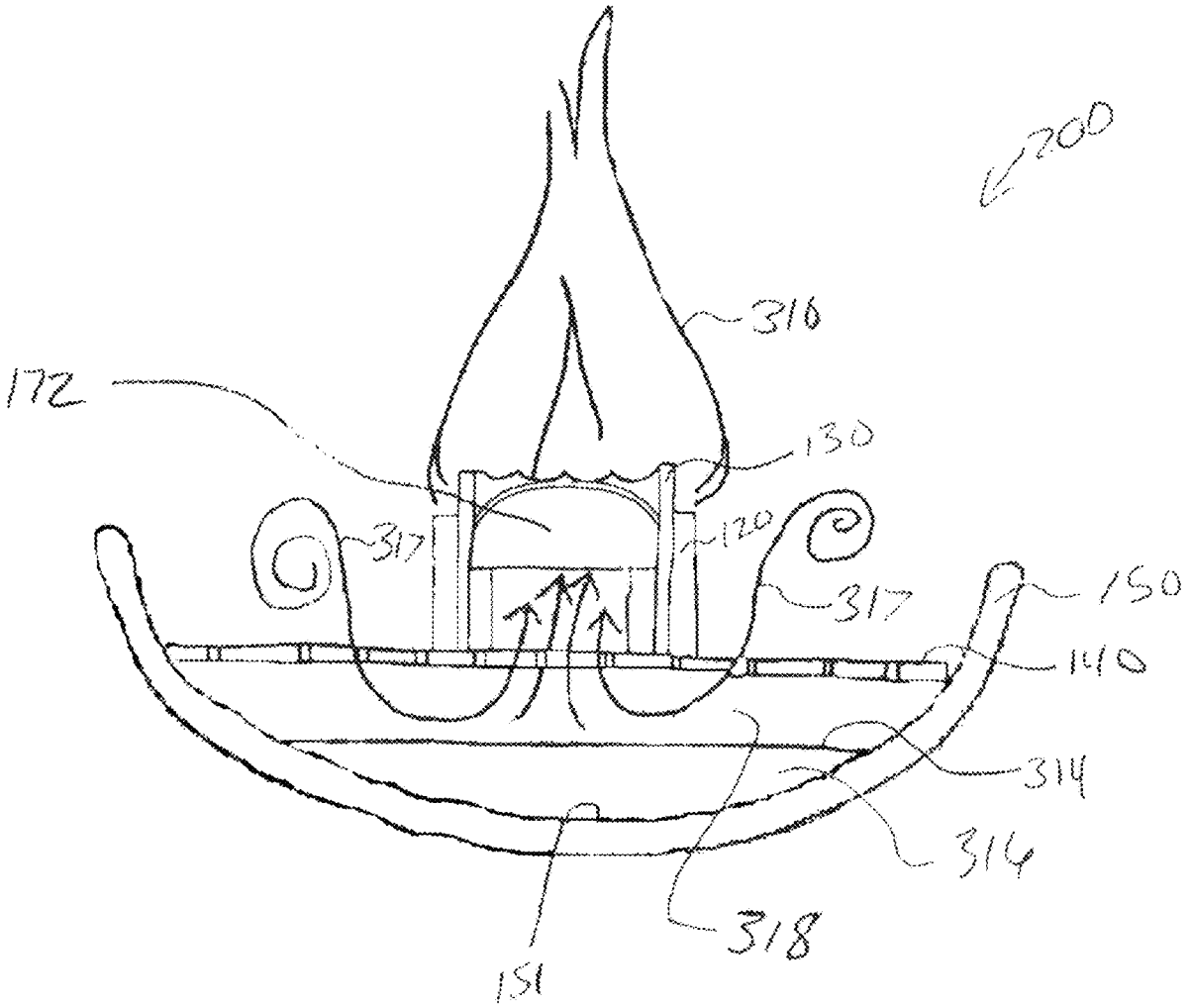
FIG. 21 is a side view of a portion of the fuel burning system of FIG. 2 in a different state of operation.

Clog Resistance. A system of method of resisting or preventing clogging of a reusable wick is disclosed. FIGS. 20 and 21 show the system 200 in various states of operation. In FIG. 15 the fuel level 304 of the liquid fuel 306 is risen above the melting grate 140 and above the bottom of the wick 130. The wick is at least partially submerged in the liquid fuel.

FIG. 21 shows the system 200 where the liquid fuel 316 has a fuel level 314 that is below the melting grate 140 and below the bottom of the wick 130. There is an air gap 318 between the fuel level 314 and the melting grate and wick.

Certain advantages are achieved when the liquid fuel level 314 is not in direct contact with the wick. When the fuel level 314 is not in direct contact with the wick 130, air 317 is drawn through the melting grate and into the bottom of the burn chamber 172 of the wick system 170. The gap 318 can be macroscopic in scale or microscopic, as long as it creates a situation where the bottom most portion of the wick material is no longer in direct contact with the fuel housed in the fuel reservoir 150 and there is a path for air to be drawn into the burn chamber from the lower opening of the wick system 170.

The gap 318 provides for an arrangement that resists or eliminates wick fouling or clogging for at least two reasons. First, throughout the operation of the system 200, since the bottom most portion of the wick is not in contact with the lowest portion of the fuel reservoir, any solids or particles that are suspended in the fuel will precipitate or fall to the bottom of the fuel reservoir and will not enter the wick material.

Second, when the fuel level sits above the melting grate, covering the bottom portion of the burner assembly and delivering fuel to the flame directly through the wick material as shown in FIG. 20, the flame 300 is sustained. However, when the fuel level is maintained below or drops beneath the grating or false bottom, the heat created by the system 200 continues to vaporize the fuel near but not in direct contact with the bottom of the burn chamber. The vaporization will occur at or adjacent the surface 314 of the liquid fuel.

As a gap is created or maintained between the bottom of the wick and the top of the fuel level 316, air begins to be drawn into the burn chamber through the bottom of the burn chamber 172. The drawn air picks up the vaporized or gas phase fuel as it proceeds into the burn chamber and/or onto the wick and the vaporized or the vapor phase paraffin is combusted. Generally wax fuels vaporize at temperatures between 390 F and 420 F depending on the type of wax. With the addition of more air into the burn chamber, the resulting fire/flame 310 burns hotter, creates more thermal energy that vaporizes more fuel, then the flame of the system operating as shown in FIG. 20 with the wick submerged in the liquid fuel. As the gap widens, toward the end or exhaustion of the fuel supply in the reservoir 150, more air will be drawn into the burn chamber and with the air more vaporized fuel, which will cause the flame to burn hotter. The flame will stop if the gap becomes too great to allow fuel to be vaporized and drawn into the chamber or if that does not first occur, then when the fuel is completely or consumed. The distance after which the gap between the wick and the liquid fuel is too great to fuel the fame depends on the scale of the overall system. In one embodiment, a gap distance of greater than ⅜ of an inch was found to be too great to continue fueling the wick. However, in larger scale systems, fueling may continue even after a ⅜ inch gap is achieved. As a result of the increase burn temperature during the end of the fuel supply, the system provides for a self-cleaning cycle where the wick eliminates or avoids particulate build up during the hotter operating temperatures at the end of fuel consumption. The self-cleaning cycle begins when the liquid level of fuel drops below the bottom of the wick and continues until no more fuel can be vaporized from the surface of the melt pool from the radiation of the flame.

Therefore the gap allows vaporized fuel to be drawn into the burn chamber premixed with oxygen with creates a hotter flame 310, as shown in FIG. 21, as compared to the stead state flame 300 that draws its fuel into the wick base a melted liquid, such as shown in FIG. 20.

Once the cleaning cycle temperature threshold is met and/or exceeded, any solids that might have clogged the wick are retained in the bottom of the fuel reservoir and any accumulated varnish, tar, carbon deposits, or other elements are consumed, volatilized, or otherwise released from the wick material as the burn chamber begins to operate at the elevated cleaning temperature. The result is an assembly resistant to the clogging or fouling than is generally seen and expected as longer chain hydrocarbon fuels like waxes or paraffin are burned.

The system provides less soot or unwanted byproducts of combustion delivered to the air because the chemical ingredients prone to incomplete combustion are either retained in the unused portion of the fuel or combusted at a higher temperature.

The gap between the bottom of the wick system and the bottom of the fuel reservoir 150 creates a thermal buffer that allows the reservoir basin or bowl to be made of materials that are otherwise prone to thermal shock or degradation.

In one embodiment, the reservoir 150 is concave in shape with a nine inch diameter and two inch height. The reservoir 150 is comprised of transparent or translucent etched glass that allows the light of the flame 310 to shine through the fuel and down to offer down lighting to the area under the reservoir. The melting grate is a flat perforated aluminum sheet of 4.25 inch diameter. This creates a distance between the melting grate and the bottom of the reservoir 150 of about 0.5 inches at the center 151 of the reservoir 150. The wick sheath has a diameter of 1.5 inch and a height of 1.1 inch and is formed by cutting aluminum tubing cut at 1.1 inch increments. The wick has a height of 1.3 and comprises Fiberfrax® 550 F ceramic paper with a wavy pattern cut at the top to facilitate ignition. The solid fuel may be IGI 1239 granulated paraffin. In this embodiment, when the system reaches its end of use, the remaining fuel in the reservoir is about 0.2 inches deep at the center 151 and the entire surface of the wick, including the upper portion of the wick supporting the flame, is relatively clean of carbon deposits and is one that can easily be relit and used repeatedly.

In some embodiments, the gap between the bottom of the wick and the lower most point of the fuel reservoir 150 at the center 151 can be as small as the thickness of the melting grate. In such an arrangement the melting grate is spaced closely to the bottom of the reservoir 150. In some embodiments, the wick may comprise any kind of non-consumable material or refractory product. In some embodiments, the wick system diameter can range from 0.25 inches to in excess of 3 inches in diameter, the wick and support ring being signed correspondingly. In some embodiments, burn devices using this method can use one or a plurality of wick systems placed upon the grate to create a customized flame effect. The customized flame effect can comprise a flame pattern that spells out a message in words or letters. The customized flame effect can comprise a flame pattern emulates a flame fountain with some parts of the flame being taller than others. The flame fountain effect can be achieved by forming some wick systems that burner taller than other wick systems on the melting grate.

Figure 22C:
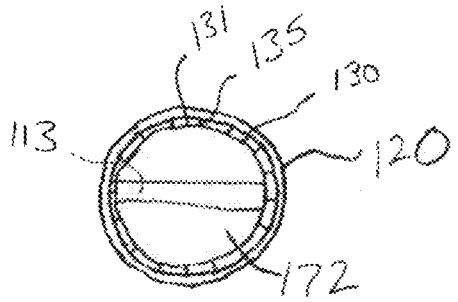
FIG. 22C is a top view of the wick and wick sheath of FIG. 2.
Figure 22D:
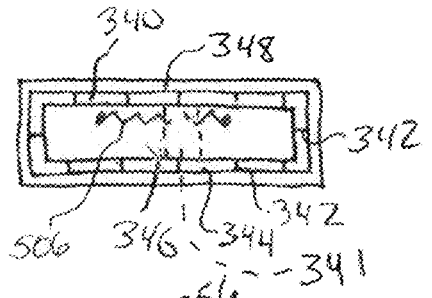
FIG. 22D is a top view of a third embodiment of a wick and a wick sheath configuration.

Wicks and Wick Sheaths. FIG. 22C provides a top view of the wick 130. FIGS. 22C-22G show alternative embodiment wicks and wick sheaths. FIG. 22D shows a wick 340 and a wick sheath 348 that are each rectangle. The top surface of the wick has peaks 342 and valleys 344 between the peaks. A burn chamber 346 is located within the wick. In other embodiments, the wick and wick sheath may comprise other quadrilateral shapes, such as a square or a trapezoid.

Figure 22E:
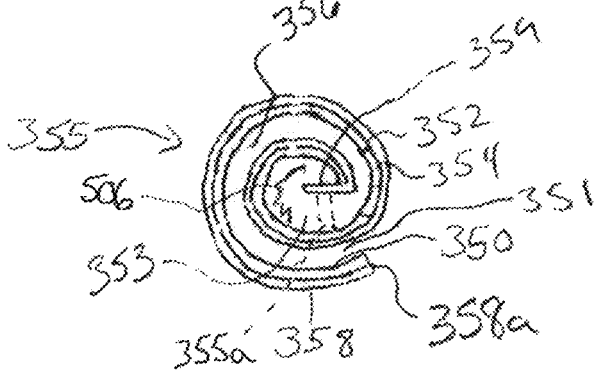
FIG. 22E is a top view of a fourth embodiment of a wick and a wick sheath configuration.

FIG. 22E shows a top view of a wick 350 and wick sheath 358 having a spiral configuration 355. The spiral configuration has an open side entrance 351. The sheath 358 has an end wall 359 at the internal end of the spiral. In this spiral configuration the inner surface of the wick faces an outside surface of the wick sheath along a portion thereof. In the center 353 of the spiral configuration a portion of the wick faces another portion of the wick rather than the wick sheath. A burn chamber 346, 347 is located within the spiral configuration 355 between the beginning 358*a* and end wall 359 of the wick sheath and/or wick. The top surface of the wick has peaks 352 and valleys 354 between the peaks.

Figure 22F:
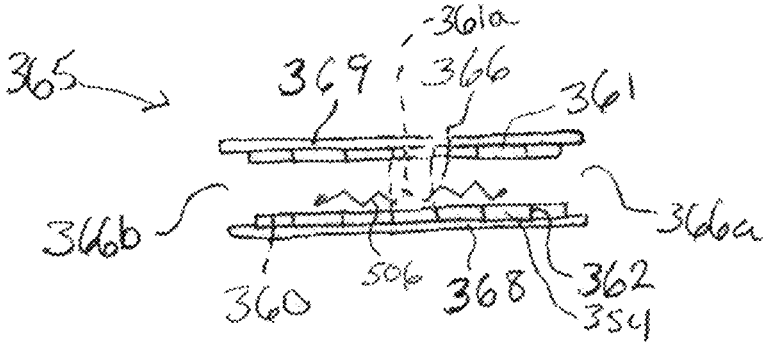
FIG. 22F is a top view of a fifth embodiment of a wick and a wick sheath configuration.

FIG. 22F shows a top view of a wick 360, 361 and wick sheath 368, 369 having a straight spaced-apart configuration 365. The straight spaced apart configuration may be a parallel configuration. The wick sheath 368, 389 is provided in two spaced apart portions and the wick is provided in two spaced apart portions 360, 361. The configuration provides for opposite open ends 366*a*, 366*b* adjacent ends of the wick and wick sheath. A burn chamber 366 is provided in the space between the interior surfaces of each wick portion 360, 361. The top surface of the wick has peaks 362 and valleys 364 between the peaks.

Figure 22G:
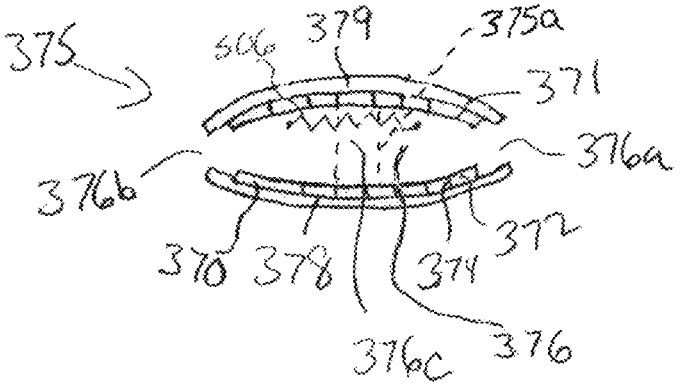
FIG. 22G is a top view of a sixth embodiment of a wick and a wick sheath configuration.

FIG. 22G shows a top view of a wick 370, 371 and wick sheath 378, 379 having a curved spaced-apart configuration 375. The wick sheath 378, 379 is provided in two spaced apart portions and the wick is provided in two spaced apart portions 360, 361. The configuration provides for opposite open ends 366*a*, 366*b* adjacent ends of the wick and wick sheath. A burn chamber 376 is provided in the space between the interior surfaces of each wick portion 360,361. The outer ends of each of the opposite wick and wick sheath portions are closer to each other along the longitudinal length than at the center 376*c*. The top surface of the wick has peaks 372 and valleys 374 between the peaks. The configurations shown in FIGS. 18-22 can be used in the burner systems 100, 200 described herein.

Figure 23:
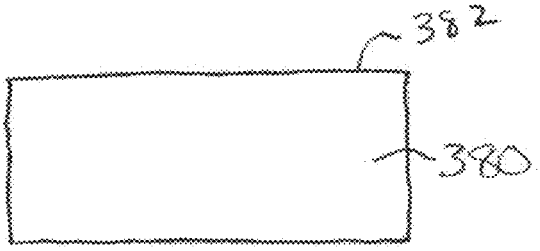
FIG. 23 is a side view of a seventh embodiment of a wick.

FIGS. 23 through 28 show alternative embodiments of top edge arrangements for wicks from a side view. FIG. 23 shows a wick 380 with a flat top edge 382.

Figure 24:
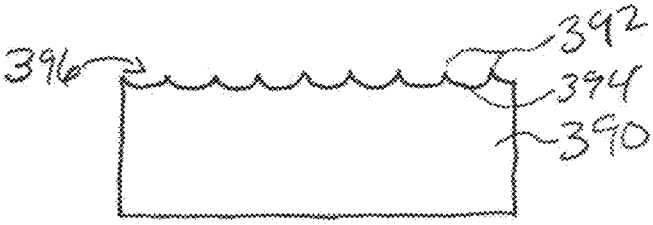
FIG. 24 is a side view of an eighth embodiment of a wick.

FIG. 24 shows a wick 390 having a wavy top edge 396. The wavy top edge has pointed or substantially pointed peaks 392 and curved valleys 394 between the peaks.

Figure 25:
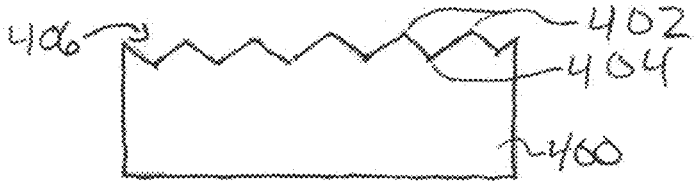
FIG. 25 is a side view of a ninth embodiment of a wick.

FIG. 25 shows a wick 400 with a jagged top edge 406. The top edge 406 has pointed or substantially pointed peaks 402 and pointed or substantially pointed valleys 394 between the peaks where the walls of the valleys or peaks are straight or substantially straight.

Figure 26:
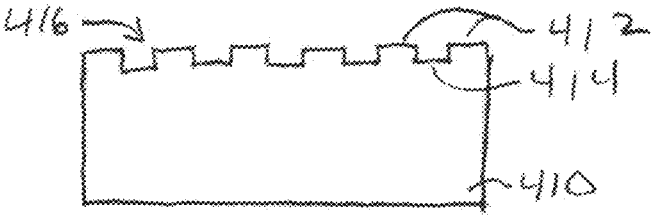
FIG. 26 is a side view of a tenth embodiment of a wick.

FIG. 26 shows a wick 410 with a notched top edge 416. The top edge 416 has plateaus 412 and valleys 414 between the plateaus. The plateaus and valleys are flat. The side walls between the plateaus and the valleys maybe perpendicular to the plateaus and the valleys.

Figure 27:
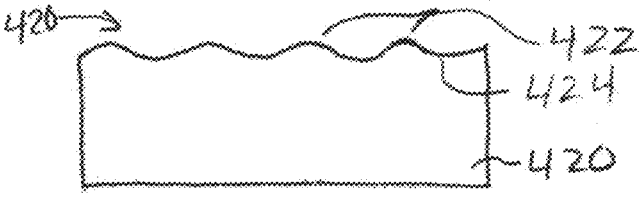
FIG. 27 is a side view of an eleventh embodiment of a wick.

FIG. 27 shows a wick 420 with a curvy top edge 416. The top edge 426 has peaks 422 and valleys 424 between the peaks. The peaks and the valleys are curved. In some embodiments, the curvy top edge resembles a sine wave.

A bridge may be provided across the burn chambers of any of the wick of FIGS. 22C-22G, such as shown with bridges 341, 355*a*, 361*a*, 375*a*.

In some embodiments, the wave pattern will create an uneven flame base creating the appearance of four flames combining into one as the flame proceeds upward from the wick. This effect may also be created with the wick shapes of at least FIGS. 24, 25, 26, 27, and 28 as well as other raised portion of the top of various wicks disclosed herein.

Figure 28:
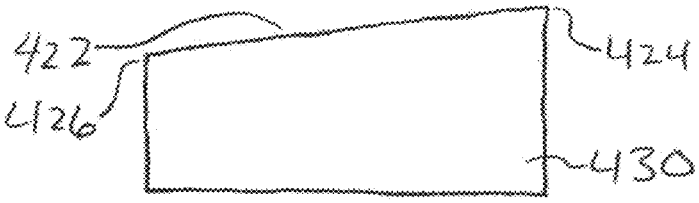
FIG. 28 is a side view of a twelfth embodiment of a wick.

FIG. 28 shows a wick 430 with an angled top edge 422. The top edge 422 has a first side 426 that is shorter than an opposite second side 424.

Each of the top edge configurations shown on wicks 380, 390, 400, 410, 420, 430, can be used any in place of wicks 110, 130, while retaining the bridge 111, 113. In other words, the wick 110, 130, can be modified to include a top edge shown for any of wicks 380, 390, 400, 410, 420, 430. The bridge may extend from one portion of the wick and be connectable to an opposite side, or the bridge may be removably attachable to each opposite side of the wick, as described above, or may be formed connected to each side. Further, a wick may use more than one top edge configuration on the same wick. For example, a wick may comprise a portion of the top edge having the jagged top edge 406 configuration and another portion of the top edge having the wave top edge 416 configuration.

The wick system uses the wick sheath to provide the boundary of the burn chamber. Within that burn chamber is wick material that only partially fills the space within the wick sheath. The wick material extends above the wick sheath to facilitate ignition and to create the top flame beneath which the vapor phase fuel is housed or staged.

The inside of the burn chamber comprises at least 10% open space. In some embodiments, the inside of the burn chamber comprises more than 50% open space. The wick material can line the inside of the wick sheath or stand apart from the wick sheath but generally has at least one surface open to the burn chamber through which surface vapor phase fuel can be delivered to the burn chamber.

A lower portion of the wick exposed to liquid or vapor fuel delivers vapor phase fuel to the burn chamber while the uppermost portion of the wick maintains the fire near the top of the burn chamber. In this way, there is always an excess of fuel ready to burn.

The combustion stoichiometry is moderated and manipulated by the access to oxygen. In the wick system, this is done generally at least in one of at least two ways. One method is to perforate the side walls, such as with the holes 124, of the wick sheath to allow air to enter into the burn chamber through the wick or directly into the burn chamber. Another method to allow oxygen into the burn chamber is around the wick surface at the top of the burn chamber. This is accomplished by creating an uneven surface upon the top of the wick, such as those shown in FIGS. 24-28. In this method, air enters from beneath or within the physical structure of the flame.

Figure 29:
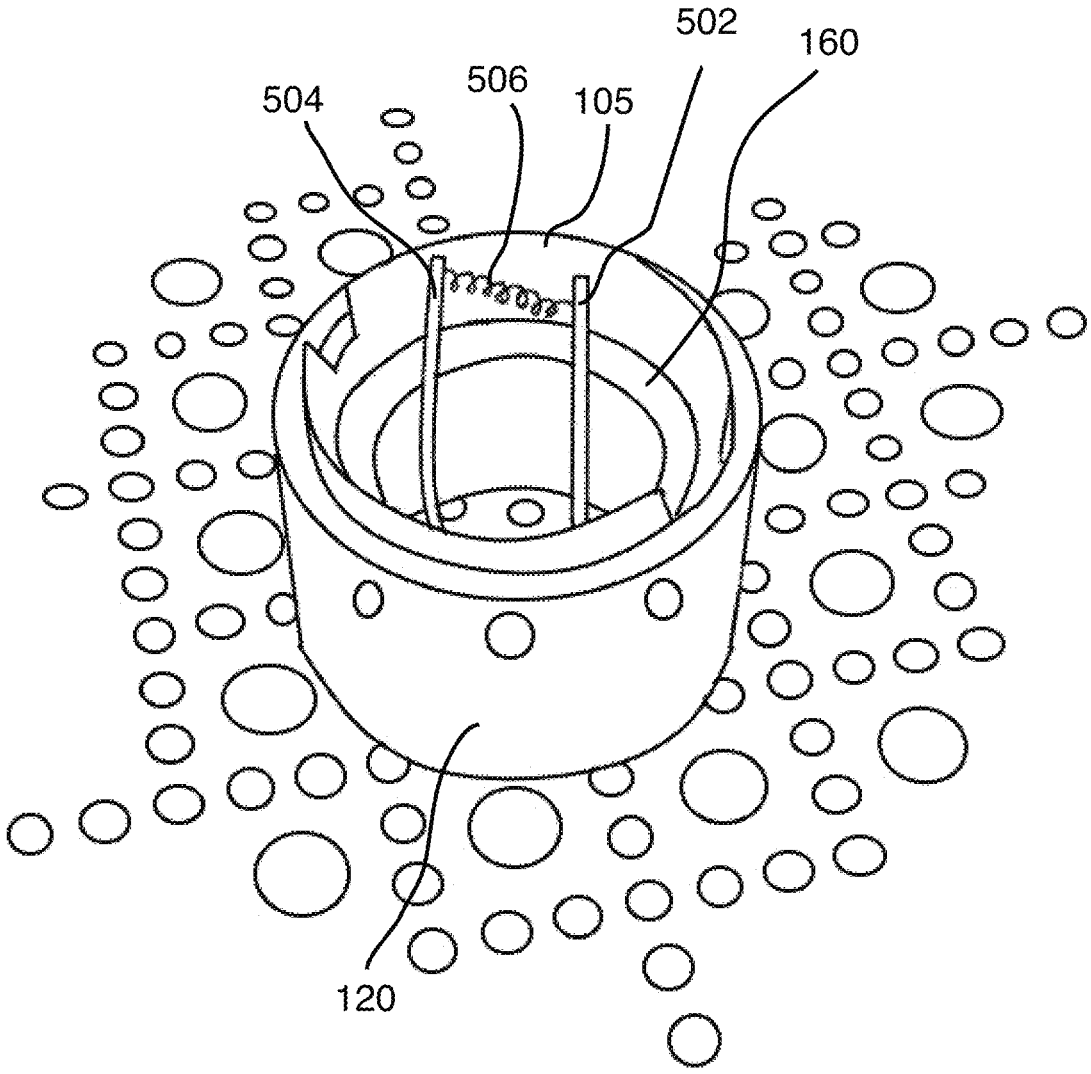
FIG. 29 is a perspective view of the system of FIG. 1 with an electronic ignition system and with an alternative embodiment wick.
Figure 32:
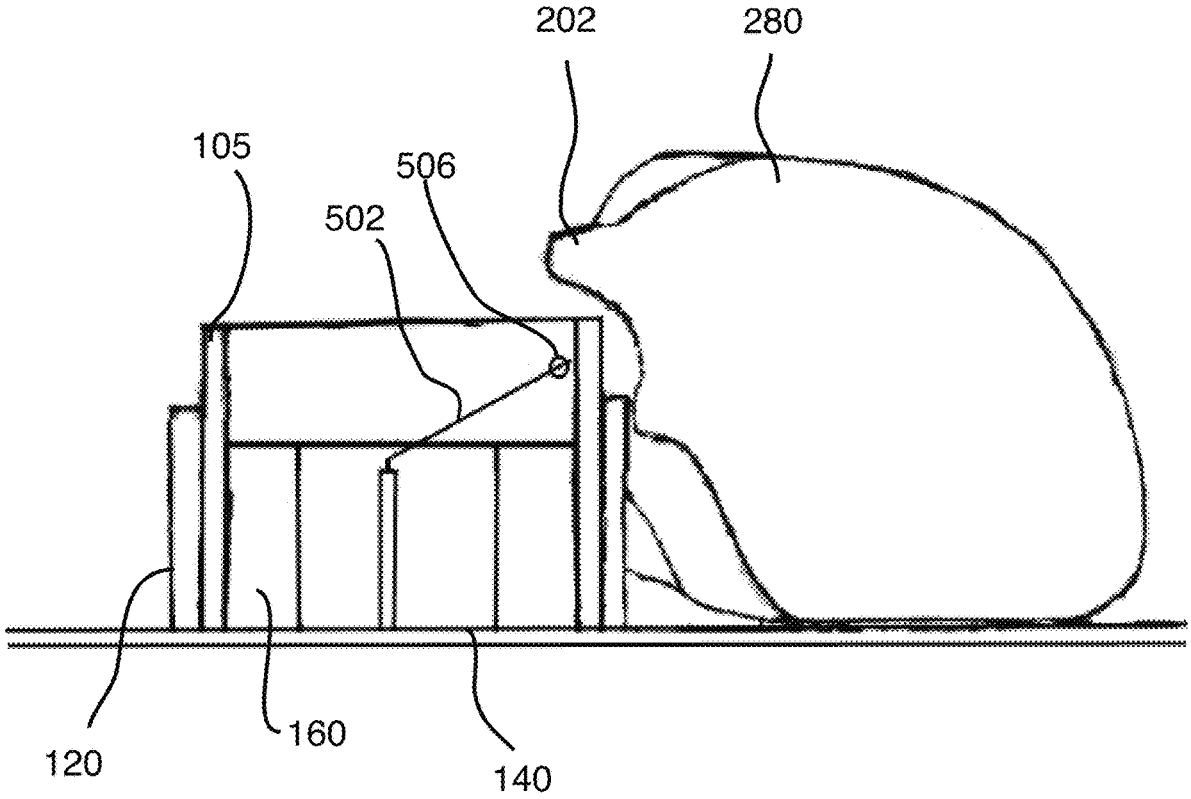
FIG. 32 is a sectional side view of the system of FIG. 29, with a solid fuel shown and taken along a line similar to line 7-7 of FIG. 6.

Electric Ignition. FIG. 22, 29-25 show an electric ignition system comprising a first post 502, a second post 504, a filament 506, and an electronic igniter circuit 508. FIG. 29 shows a wick 105 that is identical to wick 110, but that does not have a bridge. The filament is connected to each post at or adjacent the top end of each post so that the filament spans between each post and connects at opposite ends the posts. As shown in FIG. 32, an upper portion of the post may be bent toward the inside perimeter wall of the wick 105 so that the filament is placed on or adjacent in close proximity to a portion of the perimeter wall of the wick 105. The filament may be placed so that it is directly under a portion of the priming section 202 of the solid fuel 280. In other arrangements the filament may not be directly under the priming section 202, but may be adjacent the area under the priming section so that radiant heat from the filament will cause the priming section to melt and fall onto a portion of the wick adjacent the filament. The filament can be placed in any position close to the wick and adjacent a fuel source.

Figure 29A:
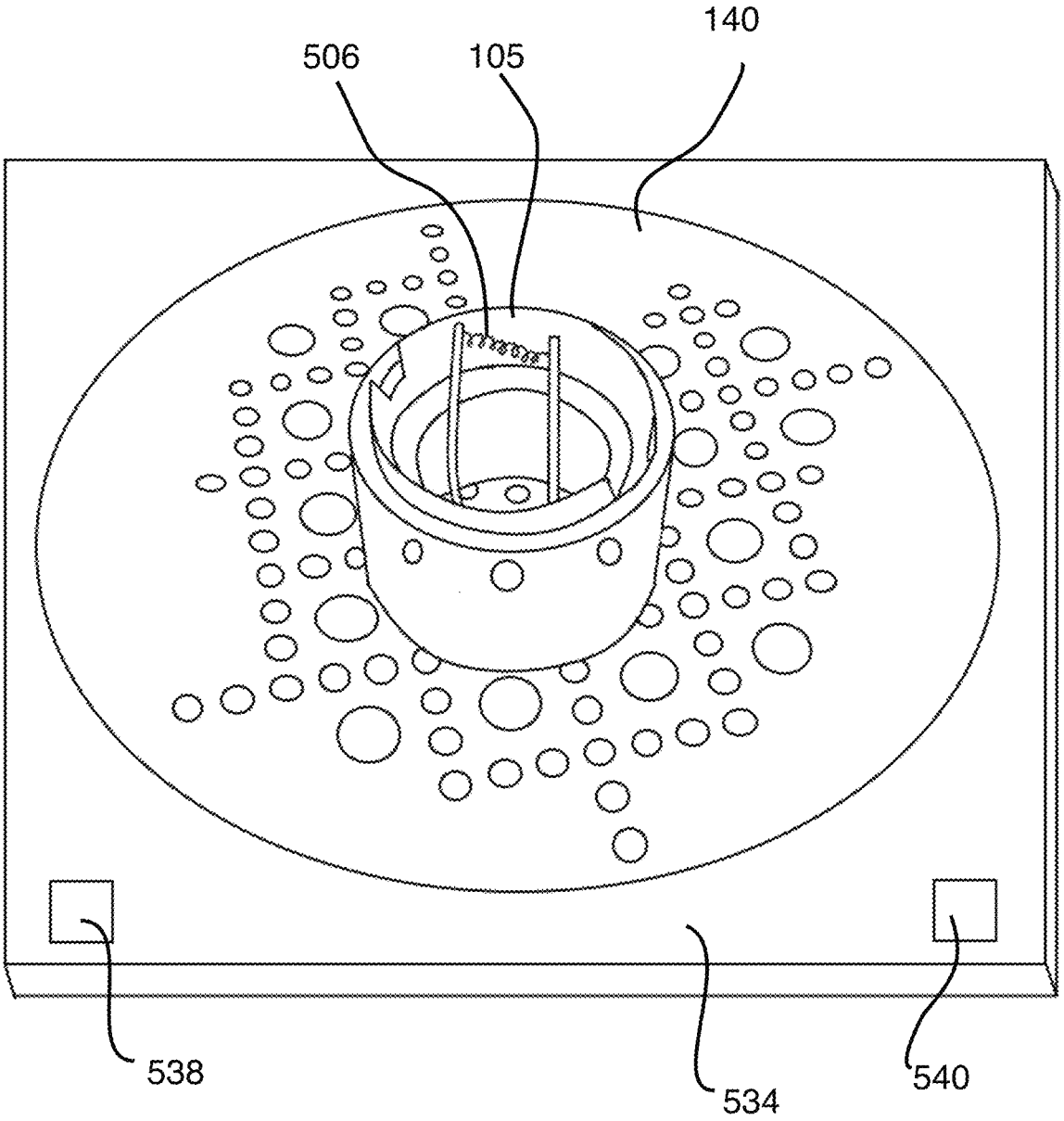
FIG. 29A is a perspective view of the system of FIG. 29 with a base and certain other components shown.
Figure 34:
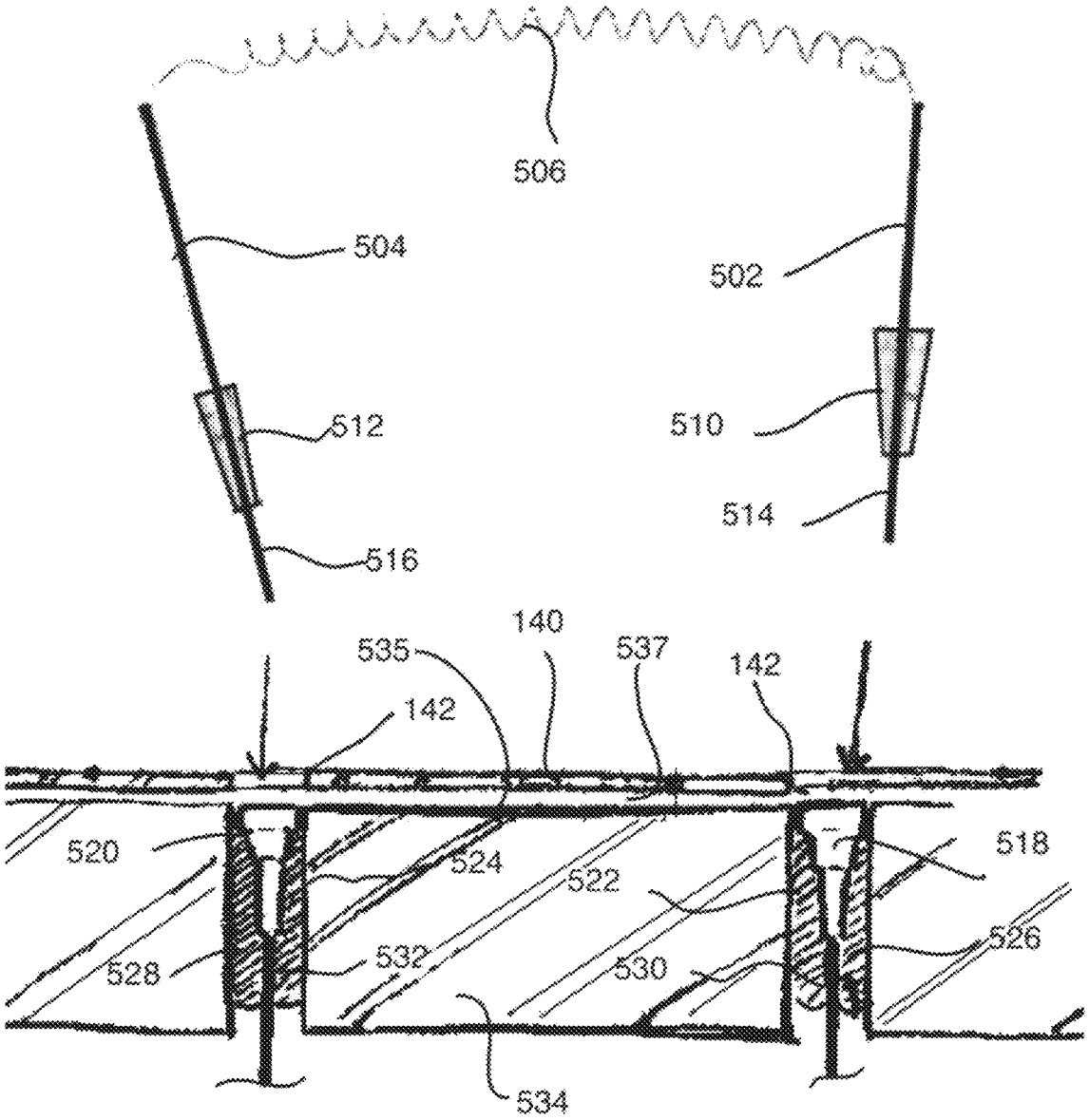
FIG. 34 is a side view of components of the electronic ignition system and melting grate of FIG. 29.

FIG. 29A, shows another embodiment of the fuel burner system 100, where a base 534 is provided about the melting plate 134. The base houses two buttons/switches 538, 540. The base may contain an alternate embodiment fuel reservoir 535 that is shallow and located under the melting grate 140. As shown in FIG. 34, the bottom of the melting grate 140 be closely spaced to the reservoir 535, so that only a small gap 537 exists between the reservoir and the melting grate.

Figure 30:
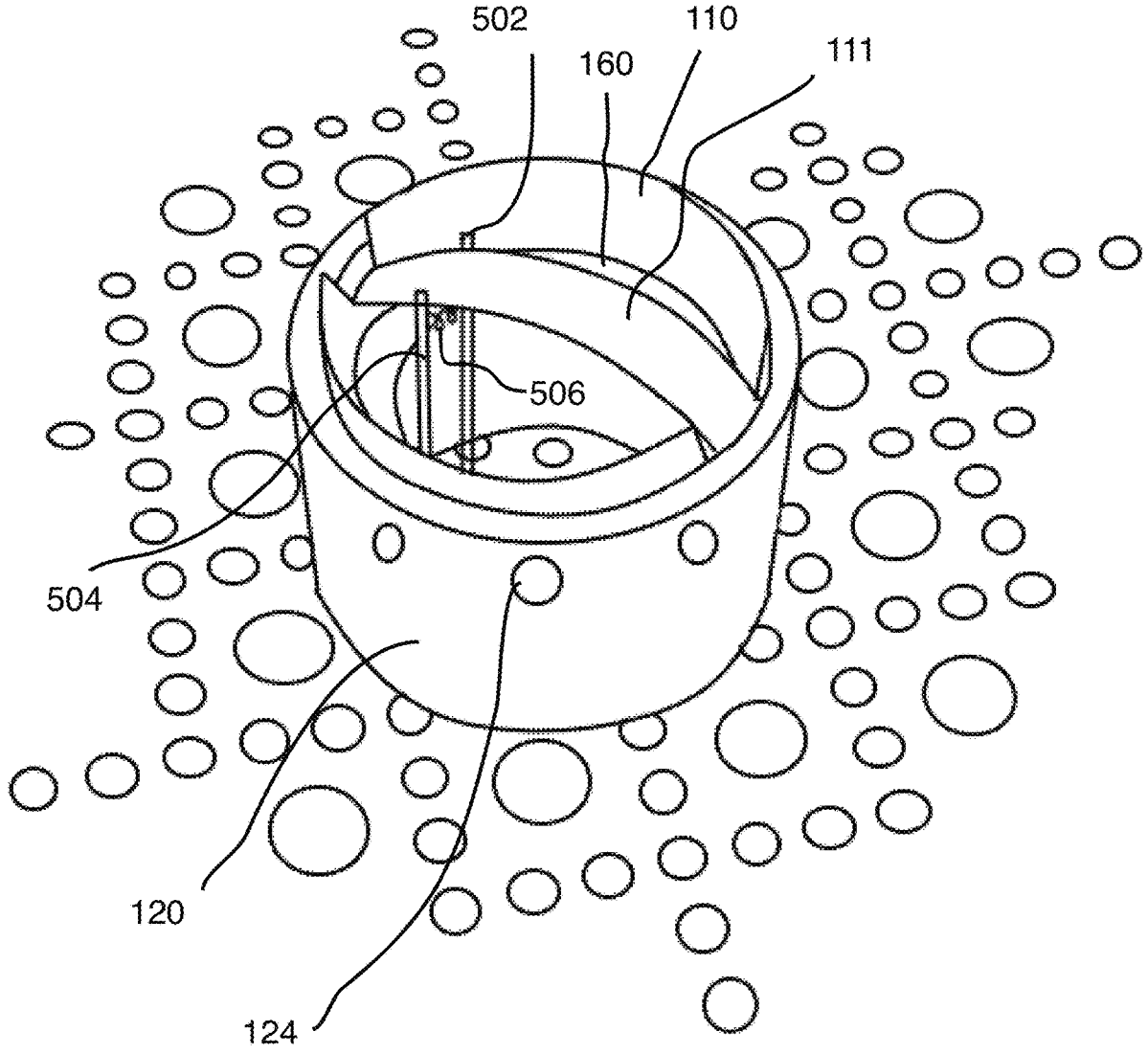
FIG. 30 is a perspective view of the system of FIG. 1 with an electronic ignition system.
Figure 31:
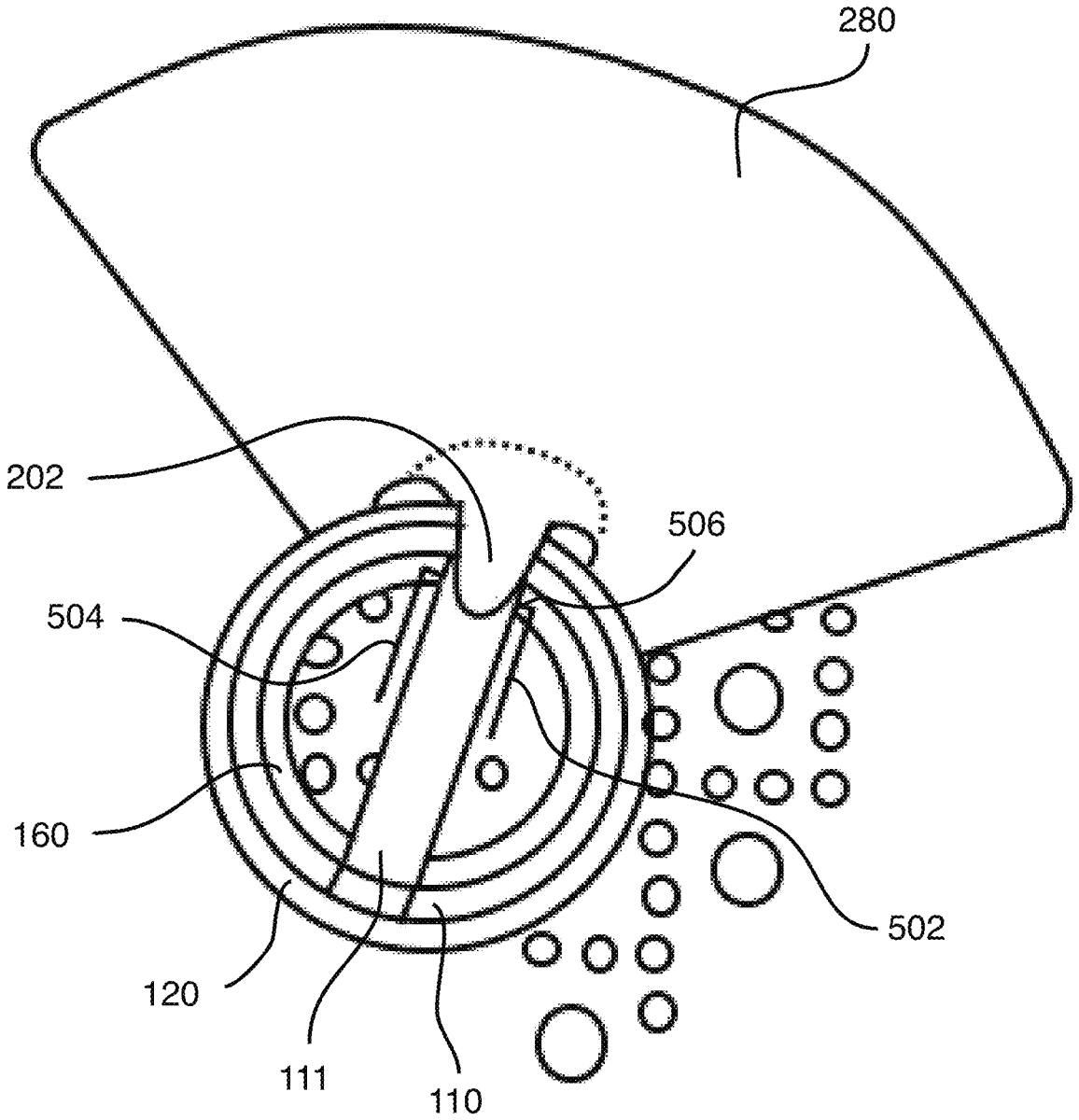
FIG. 31 is a top view of the system of FIG. 30 with the solid fuel shown.
Figure 33:
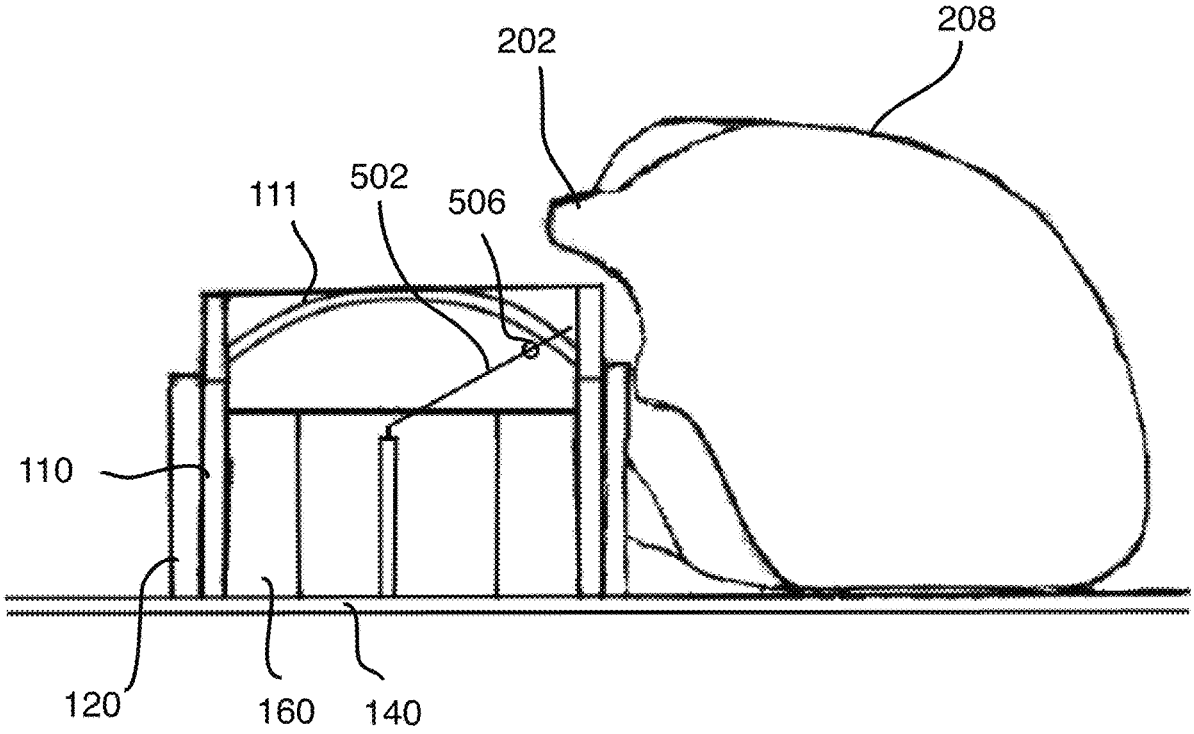
FIG. 33 is a sectional side view of the system of FIG. 30 taken along a line similar to line 7-7 of FIG. 6.

FIG. 30 shows wick 110 with the bridge 111. Each of posts 502, 504 are located on opposite sides of the bridge from the other post. The filament 506 extends under the bridge between the posts. The filament may be in contact with the bottom surface of the bridge or may be spaced apart from the bottom surface of the bridge. The filament may be placed so that it is directly under a portion of the priming section 202 of the solid fuel 280 as shown in FIG. 31. In other arrangements the filament may not be directly under the priming section 202, but may be adjacent the area under the priming section so that radiant heat from the filament will cause the priming section to melt and fall onto the bridge and/or a portion of the wick adjacent the filament, such as shown in FIG. 33. The filament may be placed next to a peak, such as peak, peaks 392, or other raised areas of the wick perimeter, such as areas 392, 412, 422, 424.

FIG. 34 shows an enlarged view of the support structure for the posts. Each post has a post dip pin 510, 512 and a bottom post portion 514, 516 extending below the post dip pin. Each of the post dip pins 510, 512 is configured to be received in support dip pin receivers 518, 520 in a reservoir 535 of a base 534 located below the melting grate 140. The post dip pins 510, 512 are shown diagrammatically and may be shaped to in the same manner as the support dip pin receivers so that the post dip pins are secured in the support dip pin receivers by friction fit. The pin receivers are secured in holes 522, 524 with a seal or sealant 526, 528, such a silicon, high temperature epoxy, a rubber seal, or other seal or sealant capable of preventing oil, melted wax, or other liquid from passing through the holes 522, 524. The base 534 may be fixed to the bottom of the melting grate. Wires 530, 532 connect to each of the support dip pin receivers 518, 520 to transfer power from the circuit 508. In some embodiments, the support dip pin receivers are mounted directly to the support grate at the holes 142 and a base 534 is not used. The posts are conductive or contain a conductive element to transfer the power from the circuit 508 to the filament.

Figure 35:
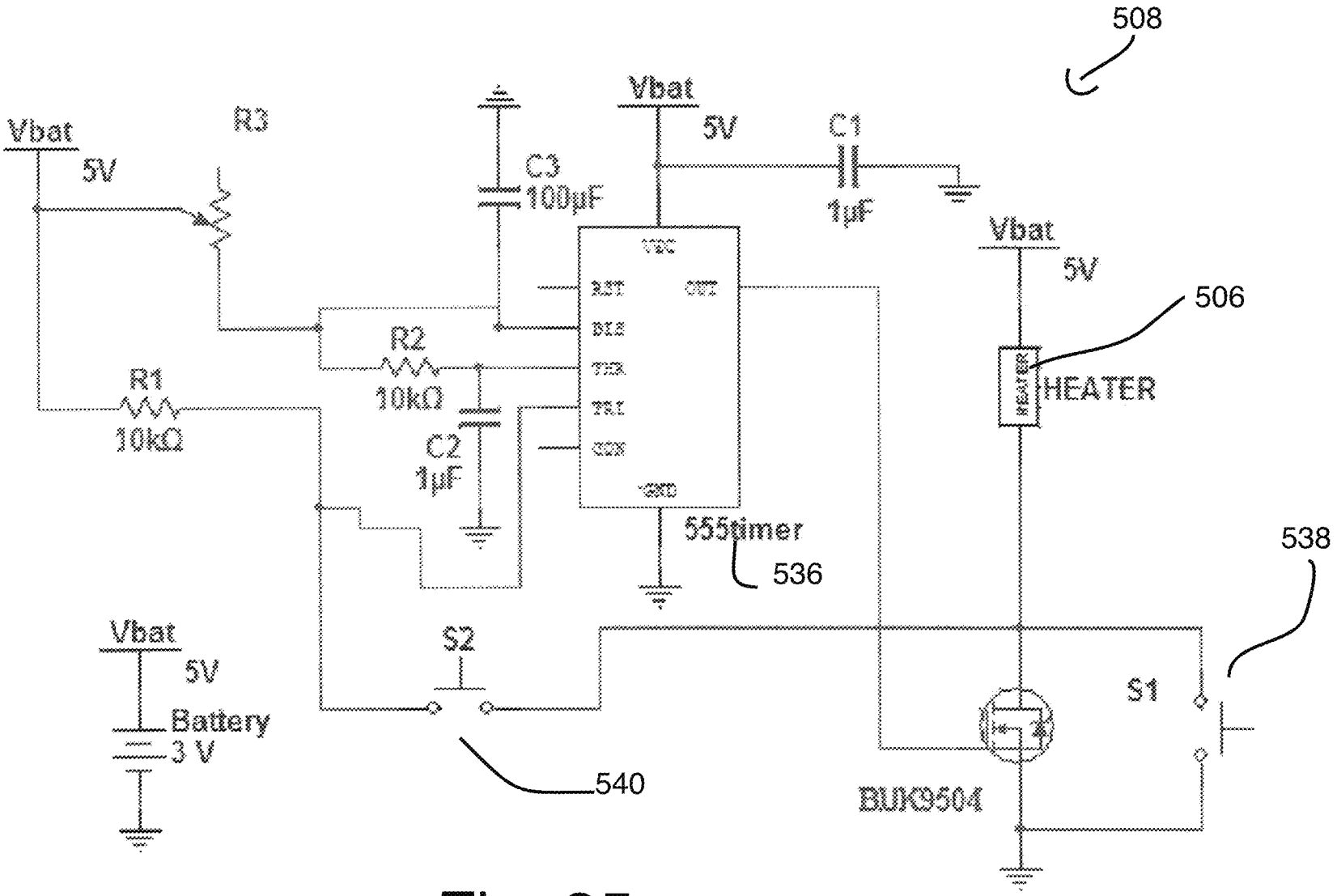
FIG. 35 is a circuit diagram of one embodiment of a circuit of the electronic ignition system.

FIG. 35 shows one embodiment of the electronic igniter circuit 508. The circuit has a power supply, such as provided by batteries (not shown). The circuit comprises a timer 536, two switches 538, 540, among other components as shown in FIG. 35. The filament is energized (1) as long as switch 538 is depressed or (2) for a predetermined amount of time, such as 45 seconds, if both the switch 538 and switch 540 are depressed simultaneously and then released. The power supplied to the filament 506 causes the filament to emit heat. In some embodiments, the circuit does not have a timer, but instead the filament is energized as long as the switches are held down. In some embodiments, the filament is always operated on a timer regardless of the how the switches are pressed. In some embodiment, only one switch is provided.

The heated filament causes the ignition of solid fuel burner system 100, 200. It accomplishes this by the filament being close to both the wax and the wick and or bridge. Close enough to result in radiation heating to both the wick/bridge and the solid wax. Upon energizing the filament, it glows and causes the radiant heat melting of the wax. The wax then flows preferentially to the perimeter of the wick, which may include a peak or raised area and/or to the bridge, which provides an ignition area. The ignition area is smaller in total size and mass and therefore has less total heat capacity than the ultimate or full wick. The heat of the filament that at first melts the wax then also heats the wick/bridge (now containing liquid wax) to its ignition temperature. In some embodiments the ignition temperature is a temperature above 375 degrees Fahrenheit. At this point the filament can be de-energized. The ignition area is positioned in such a manner relative to the melting wax as to not be prone to flooding by the continuing wax melt flow. The flame, and the filament when energized, continue to melt additional wax that will flow to the wick and enable the development of the full flame upon the full wick. That flow to the wick can be in any number of ways as long as it preferentially does not flow directly toward the initial or developing flame. The flame then continues to stay lit until substantially all of the wax is consumed by the flame.

In some embodiments, the energized filament is placed within the burn chamber or generally surrounded by the wick system 170 such that, once the ignition wick is lit and the full flame develops and as the system increases in temperature, the ignition filament is in an oxygen starved environment within the burn chamber, which protects the filament from oxidation and prolongs its useful life. The flame is located above the filament so that the filament is not directly within the flame of the wick. This location hides or partially hides the filament from external view. It also protects the filament from the high temperature at the flame burning slightly above the wick. The filament can be located level with the top of the wick or below the top of the wick and can therefore avoid the harmful effect of direct heat within the flame.

In some embodiments, the filament 506 comprises tungsten having a 0.0002 inch thickness. The filament has 10 looping turns with each loop having a 0.02 inch diameter. The electric ignition system matches the voltage delivered by the electronic igniter circuit 508 to the filament design such that the filament glows sustainably when energized with the circuit voltage.

As is shown in the figures, the filament 506 of the ignition system is placed with an upward bias toward the uppermost portion of the wick 105. When positioned in that manner, the glowing filament is in a position to cause the melting of a first portion, such as the priming portion, of a solid fuel 280 from radiation heating. That priming portion of melting wax flows preferentially or directly toward the portion of the wick close to the glowing filament, thereby priming the wick. The glowing filament then heats this primed area of the wick to the ignition temperature resulting in the first flame upon the wick. The flame then melts the next section of the solid wax refill that flows generally toward the wick assembly but not directly toward the first ignited flame. In this example, the secondary melt flows beneath the uppermost portion of the wick sheath and to the wick either through the air intake apertures or holes 124 near the top of the wick sheath or to the wick at the bottom of the wick assembly.

In some embodiments, pourable wax granules 542 as shown in FIG. 35, having a diameter of less than 0.25 inches, are used as a fuel source. In order to do this, the burn chamber must manage the granules as they are poured upon and into the assembly. The natural flow of poured granules leaves the filament in a position to melt sufficient wax, prime the wick, and ultimately ignite that portion of the wick close to the filament. Such granules can also be provided outside of the burn chamber on the melting grate adjacent the wick and wick sheath.

FIGS. 22D-22G show the ignition system deployed on various shaped wicks where the filament 506 is located adjacent to an interior wall portion of the corresponding wick.

Figure 37:
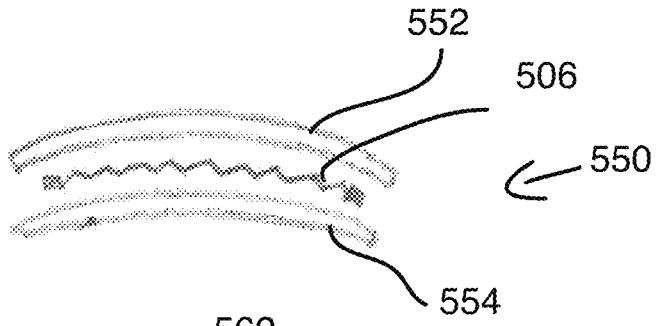
FIG. 37 is a top view of thirteenth embodiment wick.

FIGS. 37-41 shows the ignition system deployed on further alternative embodiment wick shapes. FIG. 37 shows wick 550 having a curved path configuration. The wick comprises a first concave wick portion 552 and a second concave wick portion 554 spaced from portion 552. Portions 552 and 554 have the same curvature and are oriented in the same manner so a curved path is formed between the portions. The filament is centered along the curved path between the portions 552, 544.

Figure 38:
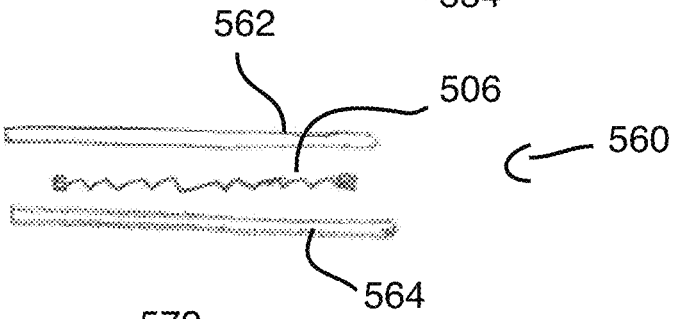
FIG. 38 is a top view of a fourteenth embodiment wick.

FIG. 38 shows a top view of a wick 560 having a straight spaced-apart configuration similar to the wick of FIG. 22F. In FIG. 38, the filament is centered between wick portions 562, 564.

Figure 39:
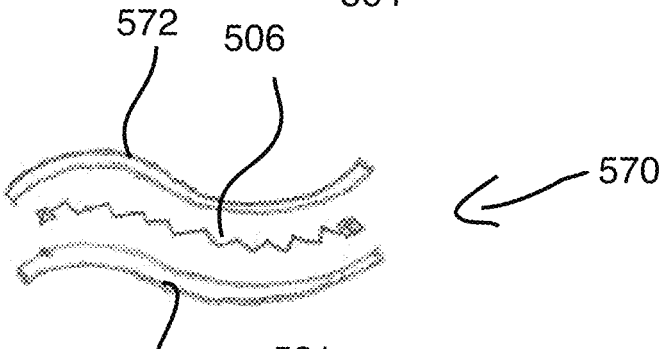
FIG. 39 is a top view of a fifteenth embodiment wick.

FIG. 39 shows a top view of wick 570 having a s-curve configuration. The first wick portion 572 has a s-shape and the second wick portion 574 has an s-shape. The first and second wick portions form an s-shaped channel between the portions. The filament 506 is centered in the s-shaped channel.

Figure 40:
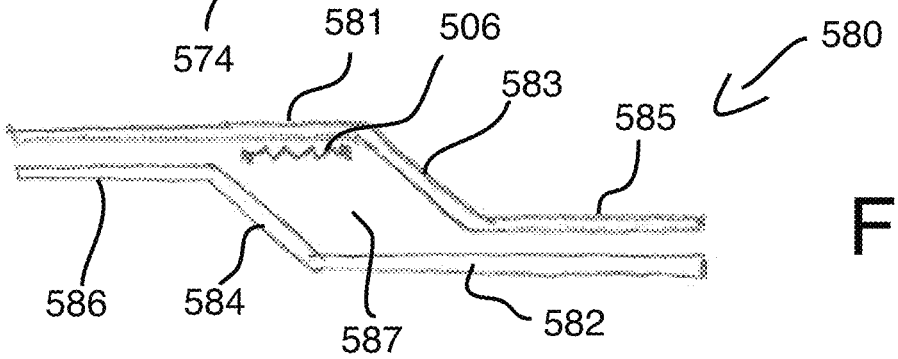
FIG. 40 is a top view of a sixteenth embodiment wick.

FIG. 40 shows a top view of wick 580 having a parallelogram configuration. A first side of the wick has a long portion 581, an angled portion 583, and a short portion 585. The second side of the wick has a long portion 582, an angled portion 584, and a short portion 586. Portions 581 and 586 form a first channel into the parallelogram center 587 of the wick. Portions 582 and 585 form a second channel into the parallelogram center. The first channel is opposite the second channel.

Figure 41:
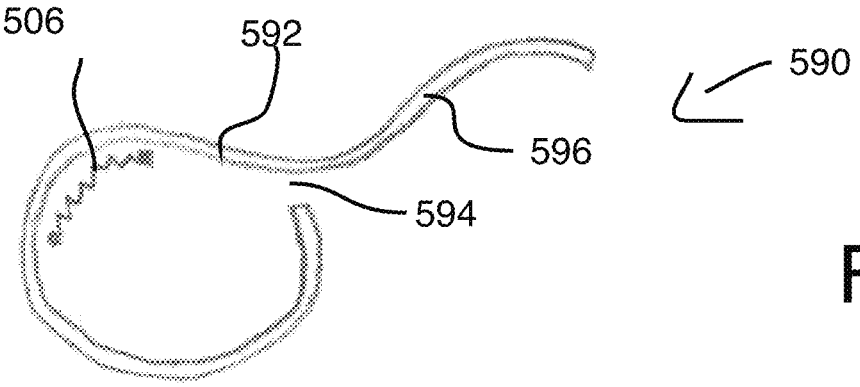
FIG. 41 is a top view of a seventeenth embodiment wick.

FIG. 41 shows a top view of wick 590. The wick comprises a semi-enclosed curved section 592, and opening 594, and an s-shaped section 596 outside of the curved section. The filament 506 is located within the semi-enclosed section and adjacent to an interior wall of the semi-enclosed section.

Figure 42:
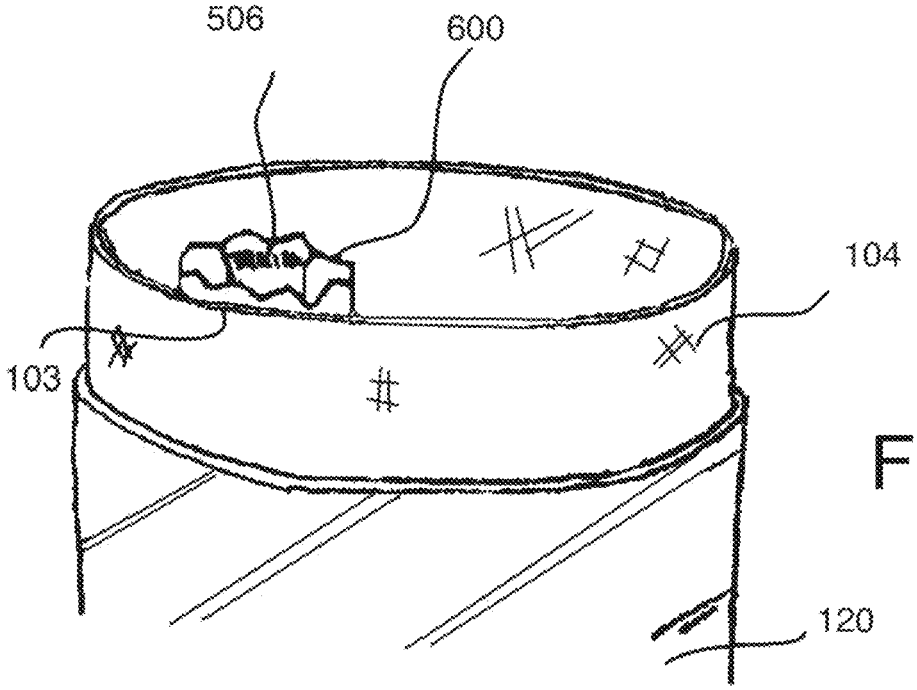
FIG. 42 is a perspective view an alternative embodiment wick with a hollow starter wick and a filament of the electronic ignition system.

FIG. 42 shows another embodiment where a hollow starter wick 600 is provided within wick 104. The hollow starter wick is the same as wick 130 except it is sized smaller to fit within wick 104. The starter wick 600 is located adjacent to a side 103 of the wick 104. The filament 506 is located within the wick 600 and adjacent to a perimeter wall of the wick 600. The flame will ignite on the starter wick and the flame will transfer from the starter wick by its close proximity to the side 103 of the wick 104 and then proceed to fully light the wick 104.

Figure 43:
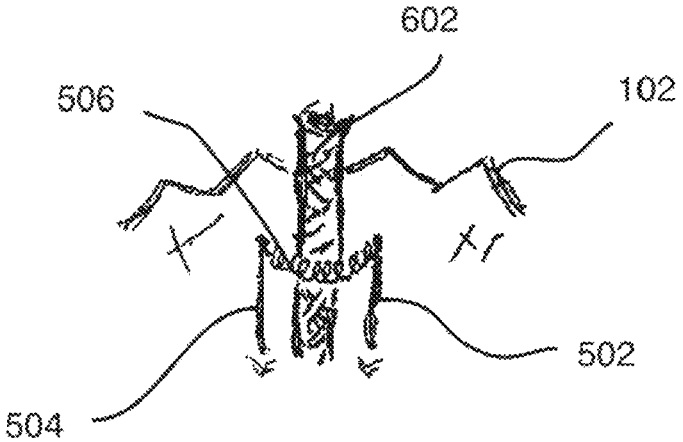
FIG. 43 is a perspective partial view of a portion of an alternative embodiment wick, a start wick, and a filament of the electronic ignition system.

FIG. 43 shows a partial view of another embodiment were a starter wick 602 is in close proximity or in contact with the side wall of wick 102. Wick 102 is identical to wick 130, except wick 102 does not have the bridge 113. The filament is in contact or in close proximity to the starter wick 602. The flame will start on the starter wick 602 and transfer the flame to the wick 130 were the full flame will develop on wick 102. The starter wick extends down to the melting great within the burn chamber and is support by the melting grate.

In some embodiments, the buttons communicate with the electronic igniter circuit 508 by wireless communication. The buttons 538, 540 are provided on a remote control that has a wireless transmitter or transceiver and the electronic igniter circuit 508 has a wireless receiver or transceiver for receiving communications from the buttons.

In some embodiments, the buttons 538, 540 are connected through wired or wireless communication to multiple electronic igniter circuits 508 and thereby multiple filaments to control the ignition of multiple solid fuel burner systems. In some embodiments the electronic igniter circuit 508 requires an access code, password, fingerprint scan, or other authentication action to authentic a user before the filament is powered. This prevents the circuit from inadvertent activation or activation by an unauthorized user, such as a child. The access code or other authentication may be provided by a user at the buttons 538, 540 or by another user input device, such as a keypad, user's phone, tablet, or computer operatively connected to the electronic igniter circuit.

In some embodiments, alternative filaments and ignition circuits can be used to operate the electric ignition system at alternative voltages, such as at 12 to 15 volts DC for outdoor landscape applications. In some embodiments, the filament comprises nichrome, tungsten, or other known materials usable as a heating filament.

In some embodiments, the filament is a different shape, such as a straight hot wire, single helix cylindrical, double helix cylindrical, planar and spiral, toroidal, or a combination thereof.

The advantages of this invention are many and some of which are provided below. The low ignition mass, particularly at the bridge and at the peaks of the wick, both fuel and wick material, allow for both ease of ignition and faster flame development. The open geometry of the burning surface creates a larger flame without the expected increase in soot production. This larger flame, then, can be used to create much faster heat delivery to the system to melt additional solid fuel, to deliver a volatile ingredient to the air more quickly, and to create a higher operating temperature that can deliver a volatile ingredient more completely to the environment. This system works especially well if coupled with a thermally conductive base (a melting plate) or a heat conductive grate. By staging the fuel in its vapor phase (ready to burn) and limiting the access to oxygen, this invention balances the combustion stoichiometry to reduce soot production and even eliminate it at the smaller scales. The staging of the vapor phase fuel within the burner assembly creates a wind resistance when the covering flame is disrupted by the wind or a breeze. The systems of the invention having a wick and or wick sheath with a diameter of 2 inches or greater have withstood 30-40 mile per hour winds without the flame being extinguished.

In some embodiments, the wick is non-consumable and has a thickness of about 1/16 inch. The wick sits against the inner wall of the wick sheath and thereby creates the burn chamber within the exposed center, lined by the wick. The wick sheath is perforated aluminum with 0.0625 inch holes near the top of the wick sheath. The wick top is patterned to offer a natural ignition point. The height of the wick sheath is about 50-66% of the wick sheath diameter. The wick may be composed of FiberFrax® ceramic paper. In this embodiment, the burner system scales well from indoor candle to table-top burner to yard torch to fire pit.

The burning system can be refined or modified to accommodate a large variety of usage applications. The overall vertical height of the system can be extended verticality to showcase the flame or create a more vertical system, such as disclosed in FIG. 2 of U.S. patent application Ser. No. 13/640,482. A system with an extended vertical height may be suitable for outdoor applications where previously yard torches, such as TIKI torches, have been used. In some embodiments, the wick materials used can be of several natures and types including but not limited to ceramic, fiberglass, porous rock, porous metal, or any other kind of refractory product like papers, felts, blankets, tissues, and mats. The thickness of the wick may be of any thickness suitable to the desired application. The burner chamber geometries can be widely varied including but not limited to cylindrical, quadrilateral, box, oval, spiral, paired linear, bracketed, among others. The wick system can be paired with a melting plate or a melting grate, such as melting grate 140 to facilitate heat transfer. The wick system can be used with a solid fuel (blocked, carved, shaved, pelleted, or granular), such as fuel 280, or a lower volatile liquid fuel (like olive oil), or a fuel formulated with a volatile active ingredient including but not limited to fragrance, insect repellent, medicinal active, or other ingredient. The wick material or mass can be continuous, non-continuous, or perforated. The non-continuous or perforated wicks allow additional heat transfer through the wick.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A wax burning system, comprising:

a melted wax reservoir;

a melting grate configured to receive a solid wax, the melting grate located above at least a portion of the melted wax reservoir so that wax melted on the melting grate can be received into the melted wax reservoir;

a wick comprising a hollow core and an upper exit opening in communication with the hollow core, the wick extending above the melting grate;

a filament support; and, an electronic ignition circuit comprising a filament, the filament is attached to the filament support, the filament is adjacent the wick, the filament is at least partially below a top of the wick, the electronic ignition circuit is configured to direct power to the filament to cause the filament to generate heat.

2. The system of claim 1, the filament and the filament support are located within the hollow core of the wick.

3. The system of claim 1, comprising a power source connected to the electronic ignition circuit.

4. The system of claim 1, wherein the circuit comprises a switch, the circuit is configured to direct power from an electric power source to the filament to generate heat at the filament when the switch is activated.

5. The system of claim 1, wherein the circuit comprises a switch and a timer, and the circuit is configured to direct power to the filament for a predetermined amount of time after the switch is activated.

6. The system of claim 1, wherein the circuit is configured to direct power from a power source to the filament to generate heat at the filament above 375 degrees Fahrenheit.

7. The system of claim 1, wherein the filament support comprises two filament supports and the filament is connected to the two filament supports and extends between the two filament supports within the hollow core of the wick.

8. The system of claim 1, wherein the filament comprises tungsten.

9. The system of claim 1, wherein the filament support is supported by the melting grate.

10. The system of claim 1, comprising a solid wax positioned on the melting grate so that a priming portion of the solid wax is positioned adjacent or above the filament.

11. The system of claim 1, wherein the wick comprises a perimeter wall and a bridge, the bridge has a first end and a second end, the first end joins with a first portion of the perimeter wall, the second end joins with a second portion of the perimeter wall, the bridge extends across the hollow core between the first and second portions of the perimeter wall; the filament is positioned under the bridge.

12. The system of claim 11, wherein the perimeter wall comprises a first perimeter wall and a second perimeter wall, the first perimeter wall comprising the first portion, the second perimeter wall comprises the second portion, the bridge extends from the first perimeter wall to the second perimeter wall through the hollow core.

13. The system of claim 11, wherein the filament is positioned under the bridge and adjacent the perimeter wall.

14. The system of claim 1, wherein the wick comprises a shape selected from the group consisting of a circle, an ellipse, a quadrilateral, a rectangle, and a spiral.

15. The system of claim 1, comprising a solid wax positioned on the melting grate so that a priming portion of the solid wax is positioned above the filament.

16. The system of claim 1, wherein the filament is located within the hollow core of the wick.

17. The system of claim 16, wherein the filament is entirely below the top of the wick.

18. A wax burning system, comprising:

a melting plate;

a wick comprising a hollow core and an upper exit opening in communication with the hollow core, the wick supported on the melting plate;

a filament support; and, an electronic ignition circuit comprising a filament, the filament is attached to the filament support, the filament is adjacent the wick, the filament is at least partially below a top of the wick, the electronic ignition circuit is configured to direct power to the filament to cause the filament to generate heat.

19. A wax burning system, comprising:

a wick comprising a hollow core and an upper exit opening in communication with the hollow core;

a filament support;

an electronic ignition circuit comprising a filament, the filament is attached to the filament support, the filament is adjacent the wick, the filament is at least partially below a top of the wick, the electronic ignition circuit is configured to direct power to the filament to cause the filament to generate heat; and, a solid wax configured to extend over the wick and the filament.

* * * * *